US007842359B2

(12) United States Patent
Marlow

(10) Patent No.: US 7,842,359 B2
(45) Date of Patent: Nov. 30, 2010

(54) ANIMATED ARTIFICIAL FLOWER

(76) Inventor: Peter Marlow, 12250 Woodley Ave., Granada Hills, CA (US) 91344

( * ) Notice: Subject to any disclaimer, the term of this patent is extended or adjusted under 35 U.S.C. 154(b) by 1020 days.

(21) Appl. No.: 11/561,208

(22) Filed: Nov. 17, 2006

(65) Prior Publication Data

US 2007/0143903 A1 Jun. 21, 2007

Related U.S. Application Data

(60) Provisional application No. 60/597,658, filed on Dec. 15, 2005.

(51) Int. Cl.
*A41G 1/00* (2006.01)
*A63H 29/10* (2006.01)

(52) U.S. Cl. ..... 428/24; 446/241

(58) Field of Classification Search ..... 428/24; 40/440, 442

See application file for complete search history.

(56) References Cited

U.S. PATENT DOCUMENTS

| | | | | |
|---|---|---|---|---|
| 530,870 | A | 12/1894 | Wenger | |
| 1,916,988 | A | 7/1933 | Pieschke | |
| 3,460,426 | A | 8/1969 | Jensen | |
| 3,471,964 | A | 10/1969 | Cherry et al. | |
| 3,811,990 | A | 5/1974 | Stoff | |
| 4,143,191 | A | 3/1979 | Chavis | |
| 4,552,339 | A | 11/1985 | Werners et al. | |
| 4,738,881 | A | 4/1988 | Lee | |
| 4,910,647 | A * | 3/1990 | Gong | 362/122 |
| 4,973,891 | A | 11/1990 | Tzeng | |
| 4,983,890 | A * | 1/1991 | Satoh et al. | 318/3 |
| 5,056,249 | A | 10/1991 | Sakurai | |
| 5,090,569 | A | 2/1992 | Nissen et al. | |
| 5,144,880 | A | 9/1992 | Schmit | |
| 5,147,265 | A | 9/1992 | Pauls et al. | |
| 5,389,030 | A | 2/1995 | Chapkis | |
| 5,522,758 | A | 6/1996 | Liu et al. | |
| 5,713,664 | A | 2/1998 | Harilela | |
| 5,776,561 | A | 7/1998 | Lindauer | |
| 5,946,835 | A | 9/1999 | Boyd | |
| 5,947,582 | A * | 9/1999 | Huang | 362/122 |
| 6,001,019 | A | 12/1999 | Al-Bannai | |
| 6,036,559 | A | 3/2000 | Arnold et al. | |
| 6,389,718 | B1 | 5/2002 | Joo | |
| 6,726,572 | B1 | 4/2004 | Versen | |

(Continued)

OTHER PUBLICATIONS

International Search Report and Written Opinion for PCT/US06/61051 dated Jul. 18, 2008.

(Continued)

*Primary Examiner*—Jennifer C McNeil
*Assistant Examiner*—Adam C Krupicka
(74) *Attorney, Agent, or Firm*—Knobbe Martens Olson & Bear, LLP

(57) ABSTRACT

A device simulating a blooming flower includes a piston slidably disposed within an elongated tube simulating a flower stem. A chamber within the stem is configured to hold a dissolvable solid material. The piston is biased upwardly, but held in place by the dissolvable solid material placed in the chamber above the piston. A simulated flower is attached to the end of the stem or piston and has a plurality of simulated petals configured to open as the stem is placed in a liquid, the solid material dissolves, and the piston moves upwardly within the stem.

8 Claims, 18 Drawing Sheets

U.S. PATENT DOCUMENTS

| | | | | |
|---|---|---|---|---|
| 2004/0111935 | A1 | 6/2004 | Tipay | |
| 2005/0084413 | A1* | 4/2005 | Stanley | 422/5 |
| 2006/0254098 | A1 | 11/2006 | Fu | |

OTHER PUBLICATIONS

International Search Report and Written Opinion for PCT/US08/66997 dated Sep. 4, 2008.
International Search Report and Written Opinion for PCT/US08/67155 dated Sep. 2, 2008.
U.S. Appl. No. 12/139,193, filed Jun. 13, 2008, Marlow, Peter.
U.S. Appl. No. 12/140,160, filed Jun. 16, 2008, Marlow, Peter.
U.S. Appl. No. 11/561,208, filed Nov. 17, 2006, Marlow, Peter.
International Preliminary Report on Patentability and Written Opinion mailed on Dec. 17, 2009 in PCT Application No. PCT/US2008/066997.
International Preliminary Report on Patentability and Written Opinion mailed on Dec. 17, 2009 in PCT Application No. PCT/US2008/067155.
Non-final Office Action mailed on Feb. 5, 2010 in U.S. Appl. No. 12/140,160.

* cited by examiner

ANIMATED ARTIFICIAL FLOWER

BACKGROUND OF THE INVENTION

The present invention generally relates to artificial flowers. More particularly, the present invention relates to a device simulating a blooming flower, which when exposed to a liquid activates an internal mechanism to open a simulated flower thereof.

Artificial flowers have been commonly used for indoor decoration. Regular artificial flowers, such as dehydrated flowers which are made of genuine flowers through dehydration process and other synthetic flowers made of plastic materials or satin ribbons, etc. are generally of a fixed type, which may present a sense of beauty, but give no vitality. Thus artificial flowers do not give a lively feeling, and thereby do not provide a pleasant feeling to their viewers.

However, natural flowers have a short life. Moreover, some flowers, such as roses, take days for their flowers to fully blossom and open. Thus, although presenting vitality and natural beauty, natural flowers also have disadvantages.

There is known in the prior art the use of animated artificial flowers and plants that simulate blooming or present a surprise hidden within artificial flower petals. However, most of these require a large assembly to hide an electric motor or hand-driven mechanism, and therefore cannot have the appearance of a long-stem cut flower. Yet others are inherently incapable of concealing a surprise gift. Still others do not simulate gradual blooming.

The inventor is not aware of any prior art of artificial flowers which bloom when placed in water or other liquid, provide ordered overlap in the petals, switch a complex electrical or mechanical function in the surprise during the opening sequence, or provide reusability by the replacement of a dissolvable solid material or provide any of the aforementioned features while utilizing a liquid absorbing and expandable material.

Accordingly, there is a continuing need for an artificial flower device which has the appearance of a long-stem cut flower and which simulates growth or blooming when placed in water or other liquid. Moreover, there is a continuing need for such a device which provides a gradual or controlled presentation of a blooming flower and which is reusable. Moreover, there is a continuing need for such a device which enables the presentation of a gift or surprise concealed within the closed flower. The present invention fulfills these needs, and provides other advantages.

SUMMARY OF THE INVENTION

The present invention resides in a device simulating a blooming flower. The animated artificial flower device, in a particularly preferred embodiment, closely resembles a long-stem cut flower that, when placed in a liquid, simulates gradual growth and blooming. In one embodiment, a gift-bearing platform is lifted out of an inner chamber concealed within the closed flower blossom as the blossom is opened. In another embodiment, a light or sound-generating electronic circuit is activated as the flower blossom is opened.

In one embodiment, the device comprises an elongated tube simulating a stem of the flower. This stem defines an inlet to a chamber therein configured to hold a dissolvable solid material. A piston is slidably disposed within the stem and biased upwardly. A simulated flower is attached to the stem and has a plurality of simulated petals configured to open as the piston is moved upwardly within the stem, and close as the piston is moved downwardly within the stem. Upon lowering the piston and inserting the dissolvable solid material within the stem chamber above the piston, and subsequently exposing the dissolvable solid to a solvent, the dissolvable solid material dissolves in the solvent and the piston moves upwardly, opening the simulated petals of the simulated flower.

A sleeve may be connected to the piston and in slidable relation to the stem. The sleeve includes an aperture alignable with the stem inlet to provide access to the chamber.

The flower comprises an inner stem slidably received within the stem, petal hinges pivotally attached to the inner stem, the petals being attached at one end thereof to the petal hinges. The inner stem is biased upwardly by a spring. The petal hinges have a spring characteristic so as to open generally flat when extended, and bow or have a curved configuration when closed. The flower may include a petal puller which is adapted to pull the petals downwardly into an open position as the piston moves upwardly. Typically, the petals comprise a set of inner petals and a set of outer petals that overlap the inner petals when in a closed position. Preferably, the flower also includes a petal cup having flexible simulated sepals formed around its upper perimeter and partially covering the petals when in the closed position. In a particularly preferred embodiment, the sepals are differentiated by thickness. Alternating thick and thin sepals surround the petals to close them with an ordered overlap. The petal cup may also include a base slidably overlying the stem and biased upwardly to simulate flower growth before blooming. The petal cup base is engageable with the inner stem so as to move upwardly when the inner stem moves upwardly. Stops are provided to engage the inner stem and/or petal cup base to limit upward movement thereof.

In one embodiment, a drive shaft is slidably disposed in an upper portion of the stem, and operably connected to the piston. The drive shaft is biased upwardly through the simulated flower by a spring. A gift platform is disposed at an end of the drive shaft or the piston. The gift platform includes a securement member adapted to secure a gift to the platform.

In a particularly preferred embodiment, a brake assembly is associated with the piston and the drive shaft. In one form, a line extends between the piston and the drive shaft. The brake assembly comprises a first pulley, a second pulley biased away from the first pulley, with a line passing over the pulleys and moving the second pulley towards the first pulley once sufficiently tensioned. A brake shoe is operably connected with the second pulley and moveable into contact with the line as line tension is lost and the second pulley is moved away from the first pulley. This brake assembly typically includes a housing through which the line extends. The first pulley is fixed to the housing and the second pulley is moveable along a slot formed in the housing. An inner wall of the housing defines a brake shoe guide.

In another form, the brake assembly comprises a brake shoe interconnected between the drive shaft and a shaft of the piston. The brake assembly is adapted to be disposed in a non-braking position when there is sufficient tension between the drive shaft and the piston shaft, but move into a braking position when there is insufficient tension between the drive shaft and piston shaft. More particularly, the brake shoe comprises a leaf spring attached to the piston shaft and having a brake pad at an end thereof. A tension line is operably connected to the drive shaft and extends to the leaf spring to hold the leaf spring and brake pad in a bowed non-braking position when there is sufficient tension.

The device may include an electronic circuit having electrical contacts that move into contact with one another to close the circuit as the flower is opened. The electronic circuit may include a light-emitting device or a sound-generating device.

In one embodiment, the piston is biased upwardly with a spring disposed between the stem and a bottom end of the piston. In such embodiment, the chamber may be defined by the piston within the stem.

In yet another embodiment, the device simulating a blooming flower comprises an elongating tube simulating a stem and a piston slidably disposed within the stem but biased downwardly. A material that expands with the absorption of a liquid is disposed within the stem below the piston. A simulated flower is attached to the piston and has a plurality of simulated petals configured to open as the piston is moved upwardly within the stem, and closed when the piston is moved downwardly within the stem. Upon placing the stem in liquid, the material absorbs the liquid through small apertures in the stem and expands, causing the piston to move upwardly, opening the simulated petals of the simulated flower. A petal puller adapted to pull the petals downwardly into an open position if the piston moves upwardly is typically incorporated into the device.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the accompanying drawings, for purposes of illustration, the present invention is related to an animated artificial flower device which simulates gradual growth and blooming. Preferably, the artificial flower device closely resembles a long-stem cut flower, and when placed in a liquid solvent, such as water, a spring and piston-driven mechanism causes a flower thereof to gradually open. In some embodiments, an electronic device is activated, and in other embodiments a gift platform is raised bearing a gift or the like. In particularly preferred embodiments, the action of the artificial flower device can be repeated.

Figure 1:
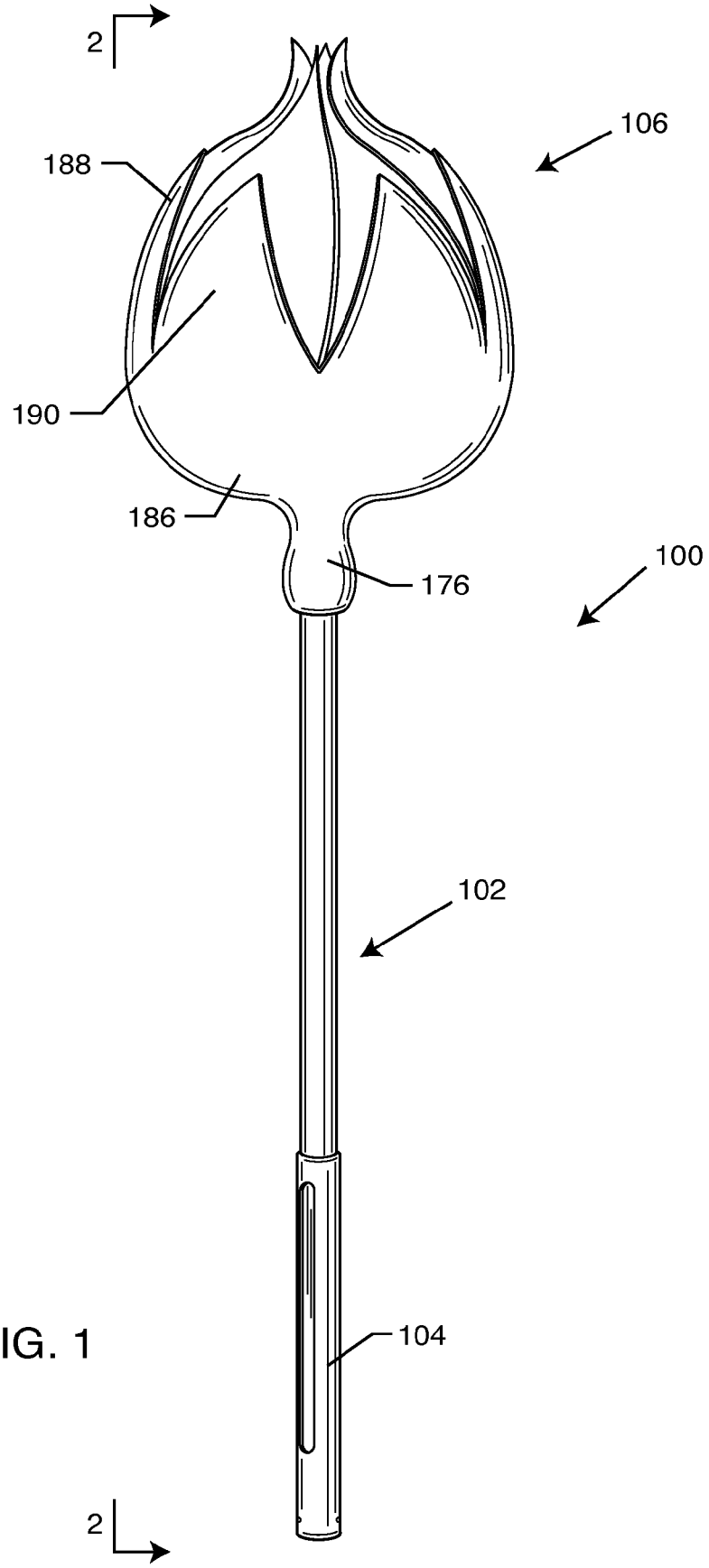
FIG. 1 is a front perspective view of an artificial flower device embodying the present invention in its closed state.

With reference now to FIG. 1, a perspective view of an artificial flower device 100 embodying the present invention is shown. The device 100 includes an elongated stem 102 which is typically an elongated tube. Although not illustrated, preferably the stem 102 has the appearance of a stem of a flower, and may have artificial leaves and the like attached. It will also be appreciated by those skilled in the art that the elongated stem 102 may be provided in multiple sections joined to one another for purposes of assembly and the like.

In the embodiment illustrated in FIGS. 1-11, a sleeve 104, comprising a round tube slightly larger in diameter than the stem 102 is slidably disposed over the stem 102. In particular, as will be more fully described herein, the sleeve 104 is attached to an internal piston. A simulated flower 106 is attached to a generally opposite end of the stem 102.

With reference now to FIGS. 2-5, the internal components of the device 100 are illustrated. A piston 108 is slidably disposed within the stem 102. The piston 108 is typically a cylindrical tube with a closed end and rounded corners. The piston 108 is attached to the sleeve 104, such as by the use of a pin 110 extending through the piston 108, through grooves 112 formed in the stem 102 and into the sleeve 104. The grooves 112 of the stem 102 enable the pin 110 to travel along a lower portion of the stem 102 as the piston 108 and sleeve 104 are moved upwardly and downwardly along a lower length of the stem 102. The sleeve 104 includes small apertures 114 for receiving the pin 110 therethrough, as illustrated in FIG. 9.

A line 116 is connected to the piston 108 at one end thereof, and extends to a drive shaft 118 disposed within the stem 102 at an upper end thereof. The line 116 may be comprised of any appropriate material, such as a monofilament material or the like. The line 116 is under tension due to a spring 120 disposed within the stem 102 and engaging a lower end of the drive shaft 118, and a base 122 disposed within the stem 102 above the piston 108. The natural reaction of the spring is to expand and push the drive shaft 118 upwardly. This biases the piston 108 upwardly as well as it is connected to the drive shaft 118 by line 116.

Figure 9:
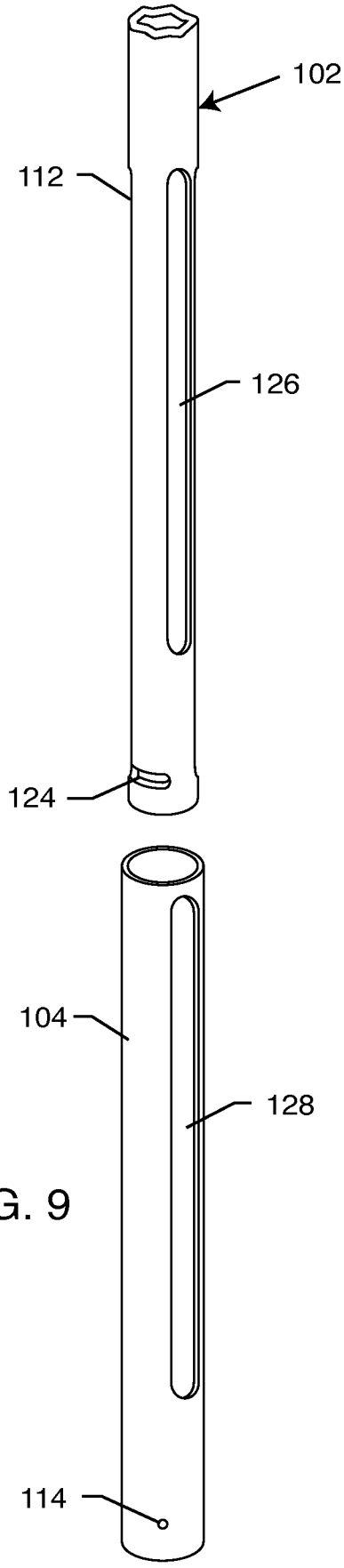
FIG. 9 is a partially fragmented, perspective and exploded view of a stem and sleeve, used in accordance with the present invention.
Figure 10:
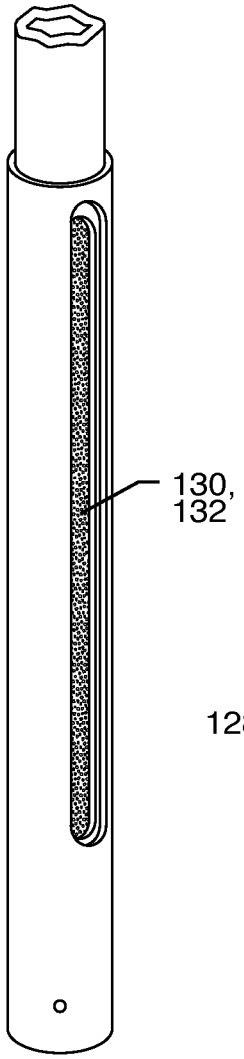
FIG. 10 is a fragmented perspective view of the stem and sleeve positioned so as to access an inner chamber of the device.
Figure 11:
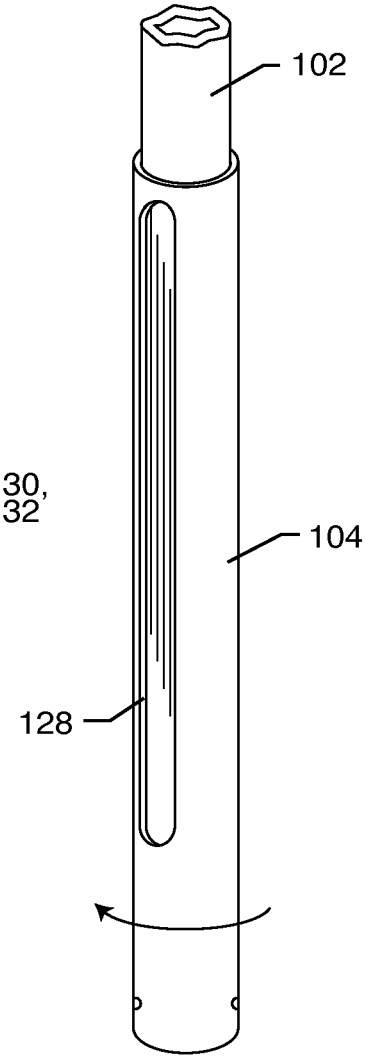
FIG. 11 is a fragmented perspective view similar to FIG. 10, illustrating rotation of the sleeve to close access to the inner chamber.

With reference now to FIGS. 9-11, when the piston 108 is retracted towards the bottom end of the stem 102, such as by pulling sleeve 104 downwardly, the piston 108 can be temporarily locked into this bottom position by twisting the sleeve 104 until the piston pin 110 is moved into a piston pin lock slot 124. Both the stem 102 and the sleeve 104 have apertures 126 and 128. The stem aperture 126 is an inlet into an inner chamber thereof for inserting a dissolvable solid material. When the sleeve 104 is rotated such that the pins 110 are moved into slot 124, so as to lock piston 108 in place, the apertures 126 and 128 are aligned with one another, as illustrated in FIG. 10 such that the dissolvable solid material 130 can be placed into the inner chamber 132. The inner chamber is defined by the position of the piston 108 and a washer 134 disposed within the stem 102. The washer 134 is typically comprised of a hard rubber material and is a round flat washer having a small aperture therethrough to allow line 116 to pass therethrough. The washer 134 retains the solid material 130 within the chamber 132, and reduces entry of liquid into the upper mechanisms, as will be described more fully herein.

The dissolvable solid material can be any material which can be inserted into the chamber 132 and which is dissolvable by a solvent liquid. It is contemplated by the present invention that such dissolvable solid material could comprise granulated sugar. Of course, other dissolvable materials are also possible, such as soluble tablets, table or rock salt, dissolvable solid plug inserts, granules of candy, flavored drink mix, etc. However, sugar is readily available and dissolves quickly in water. Moreover, sugar is granulated and easy to pour into the chamber 132 through aligned apertures 126 and 128. When the piston pin 110 is released from the lock slot 124 by turning the sleeve 104 as illustrated in FIG. 11, the piston 108 is held in place by the presence of the solid material 130 within the chamber 132. Settling of the solid material 130 by the piston 108 compression will result in a slight advance of the piston 108, which will move the pin 110 out of alignment with the lock slot 124 and prevent any further undesired rotation of the sleeve 104.

There remains the possibility that when attempting to lock the piston pin 110 into lock slot 124 to fill the chamber 132 with solid material 130, that the user may inadvertently release the sleeve 104, allowing the sleeve 104 and piston 108 to quickly move upwardly within stem 102, causing drive shaft 118 to be pushed upwardly in a rapid manner by spring 120. This will cause the quick and violent opening of flower 106, which is undesirable and could cause the loss of the surprise gift. Accordingly, the present invention contemplates the use of a brake assembly 136 in such lost line tension circumstances. The brake assembly 136 is disposed intermediate to the piston 108 and the drive shaft 118, as illustrated in FIGS. 2-5.

Figure 12:
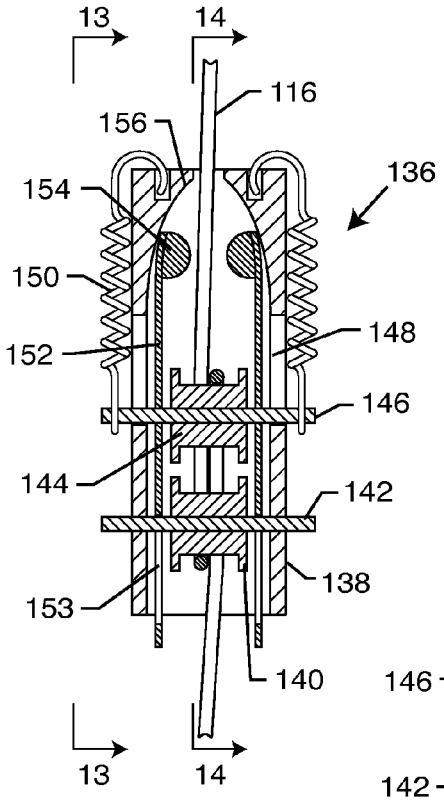
FIG. 12 is a cross-sectional view of a brake assembly used in accordance with the present invention, illustrating the braking assembly in a non-braking position.
Figure 13:
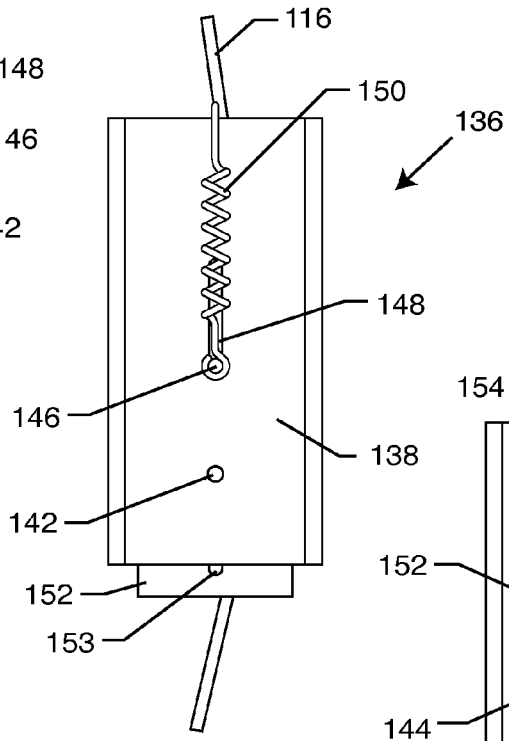
FIG. 13 is a side elevational view taken generally along line 13-13 of FIG. 12.
Figure 14:
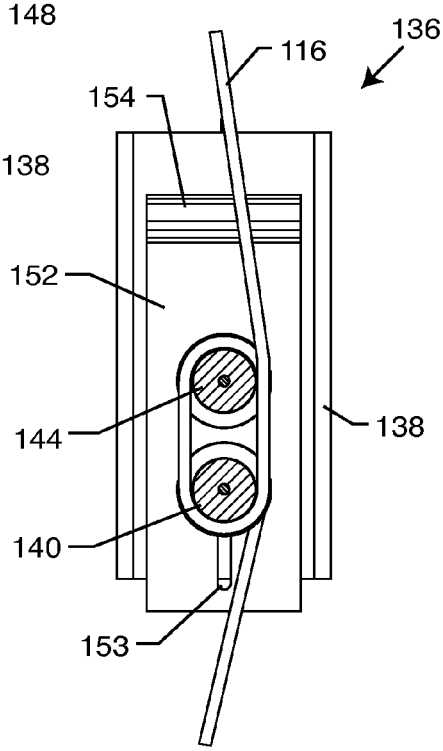
FIG. 14 is a cross-sectional view taken generally along line 14-14 of FIG. 12.

An exemplary brake system is illustrated in FIGS. 12-17. FIGS. 12-14 illustrate the brake assembly when in a normal, non-braking mode. The assembly 136 includes a housing 138, comprising a box structure. The first pulley 140 is rotatably connected to a pulley axle 142, which extends through the housing 138 in fixed relation thereto. A second pulley 144 is rotatably mounted to an axle 146 which resides in a slot 148 formed in the housing 138. One or more springs 150 bias the pulley axle 146 upwardly. However, line 116 which passes over both pulleys 140 and 144, when tensioned, serves to pull the pulleys 140 and 144 towards one another, as illustrated in FIGS. 12-14. A brake shoe 152, and more typically two or more brake shoes, are connected to the second pulley axle 146. The brake shoe includes a brake pad 154. The brake shoe 152 is configured as a flat and slightly flexible rectangular mount, as illustrated in FIG. 14, which travels generally along the inner surface 156 of the housing 138. A slot 153 in the brake shoe 152 provides clearance for axle 142. As illustrated in FIG. 12, the inner surface or wall 156 of the housing 138 curves inwardly towards line 116.

Figure 15:
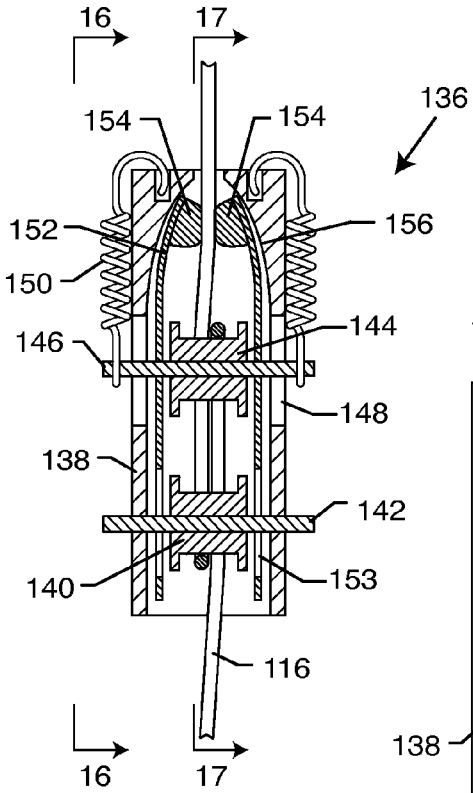
FIG. 15 is a cross-sectional view similar to FIG. 12, but illustrating the braking assembly in a braking position in response to a lost tension condition of the line.
Figure 16:
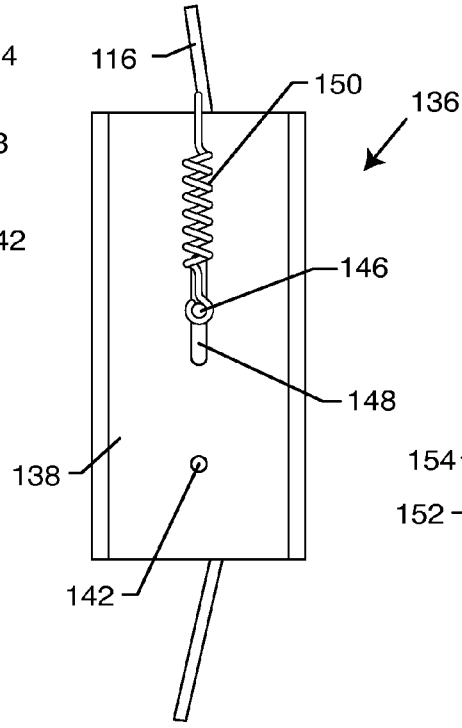
FIG. 16 is a side elevational view taken generally along line 16-16 of FIG. 15.
Figure 17:
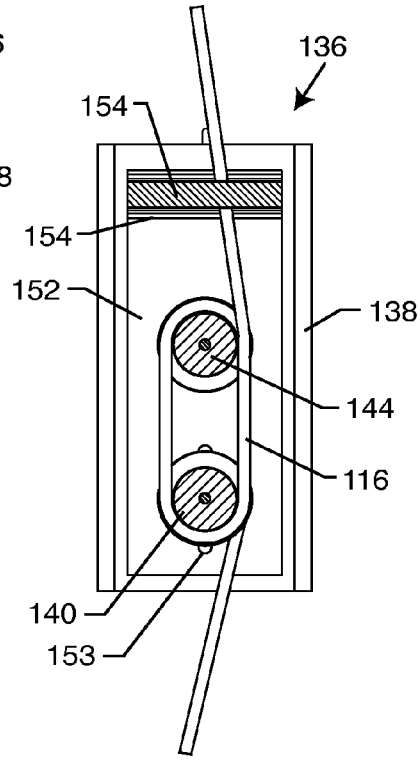
FIG. 17 is a cross-sectional view taken generally along line 17-17 of FIG. 15.

With reference now to FIGS. 15-17, when tension is suddenly lost on the line 116, such as when lowering sleeve 104 to position the apertures 126 and 128 to fill the inner chamber of 132, which is accidentally released before the piston pins 110 are completely inserted into locking slot 124, one or more springs 150 pull piston axle 146 upwardly through slot 148 of the housing 138 of the brake assembly 136. This occurs as the bias of the springs 150 overcomes the tension in the line 116, which would otherwise hold the pulley 144 in close proximity to pulley 140. The upward motion of axle 146 pulls the brake shoe 152 with it upwardly as well, and the brake pads 154 to come into contact and pinch line 116, as illustrated in FIG. 15. The gripping of the line 116 by the brake pads 154 retards or stops the motion of the line 116 and consequently all flower assemblies. The device 100 can be reset by simply pulling the sleeve 104 downwardly to restore tension to the line 116, causing the brake shoes 152 to move downwardly again with the pulley 144 and axle 146.

With the dissolvable solid material 130 placed within inner chamber 132, the piston 108 cannot move upwardly until the material 130 is removed or dissolved. This is done by placing the stem 102 into a liquid solvent, such as water. Of course, it will be appreciated that this will simulate the placement of a cut flower into water. The water, or other solvent, enters into the chamber 132, by infiltration through gaps between the sleeve 104 and stem 102, and other components of the device 100. Of course, the stem 102 and/or sleeve 104 can include apertures specifically designed to allow the solvent to enter into the chamber 132. As the water or other solvent enters the chamber 132, the solid material 130 begins to dissolve and go into solution. As this occurs, piston 108 is moved upwardly. The rate at which the solid material 130 dissolves and the piston 108 moves upwardly can be controlled by many factors, including: the nature and composition of the solid material 130, the temperature of the solvent, the fit of the sleeve 104 over the stem 102, porosity of the materials used to construct the sleeve 104 and the section of stem 102 surrounding the chamber 132, the size of the granules of the solid material 130, and the presence of previously dissolved solids 130 in solution in the solvent. Thus, the time required for the piston 108 to move fully through the chamber 132 can range from a few minutes to many days.

Figure 2:
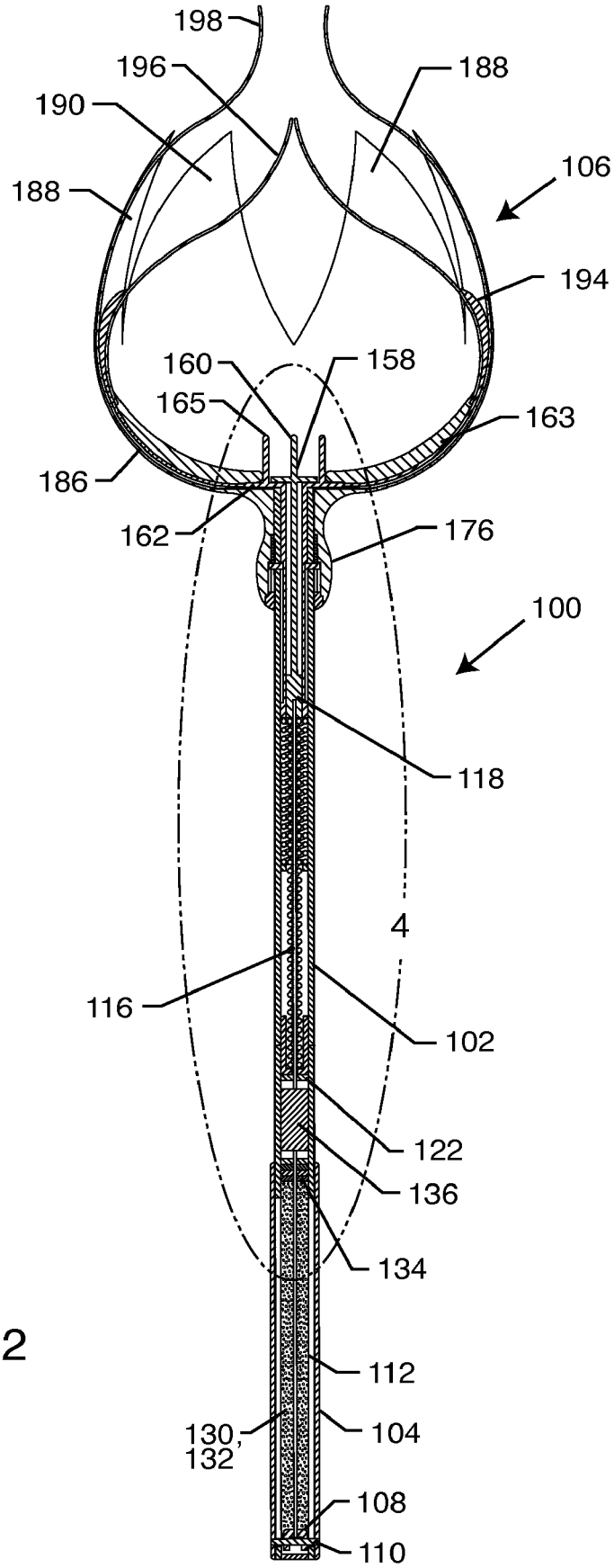
FIG. 2 is a cross-sectional view taken generally along line 2-2 of FIG. 1, illustrating various component parts of the device.
Figure 3:
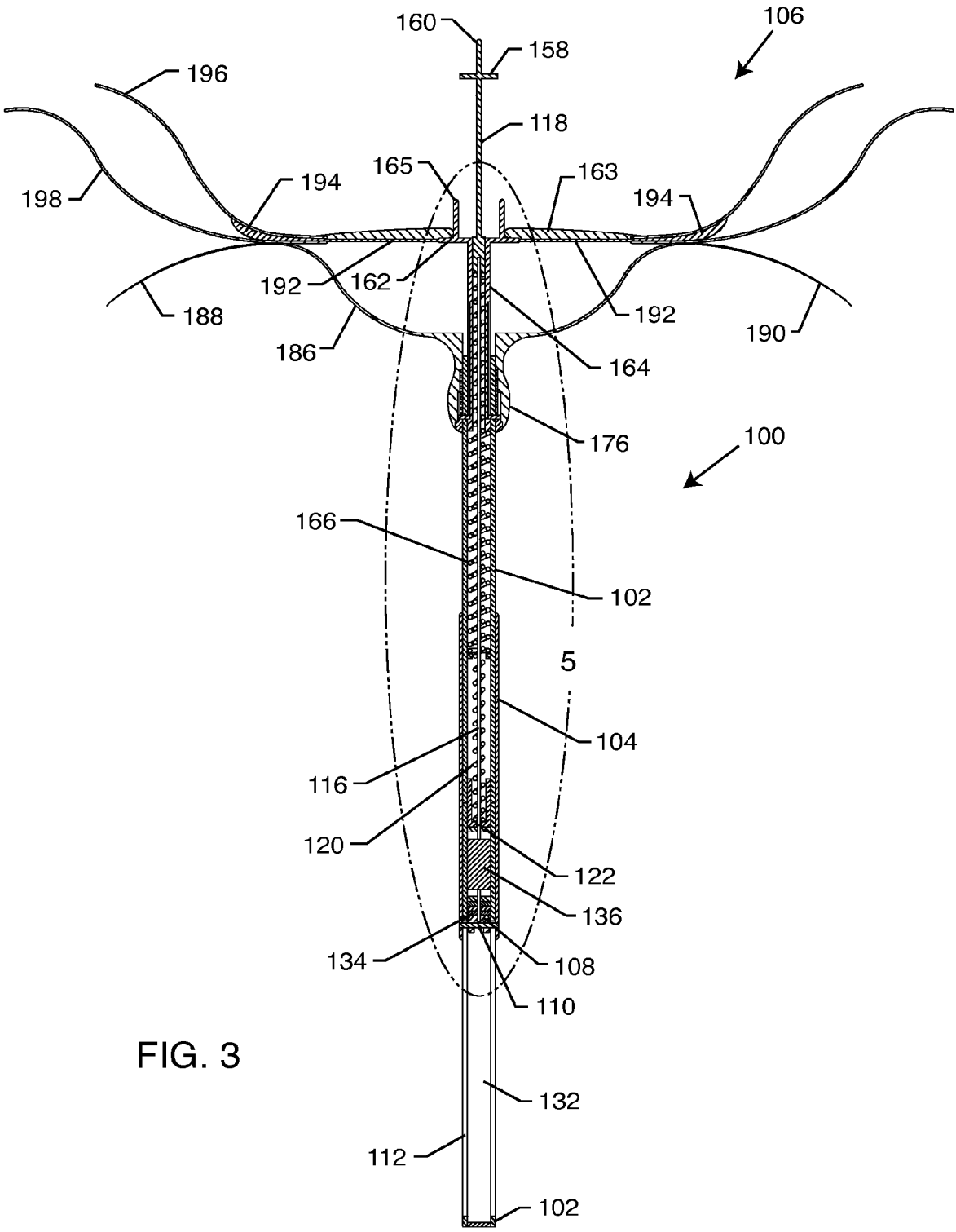
FIG. 3 is a cross-sectional view similar to FIG. 2, but illustrating the artificial flower device in an opened state.
Figure 4:
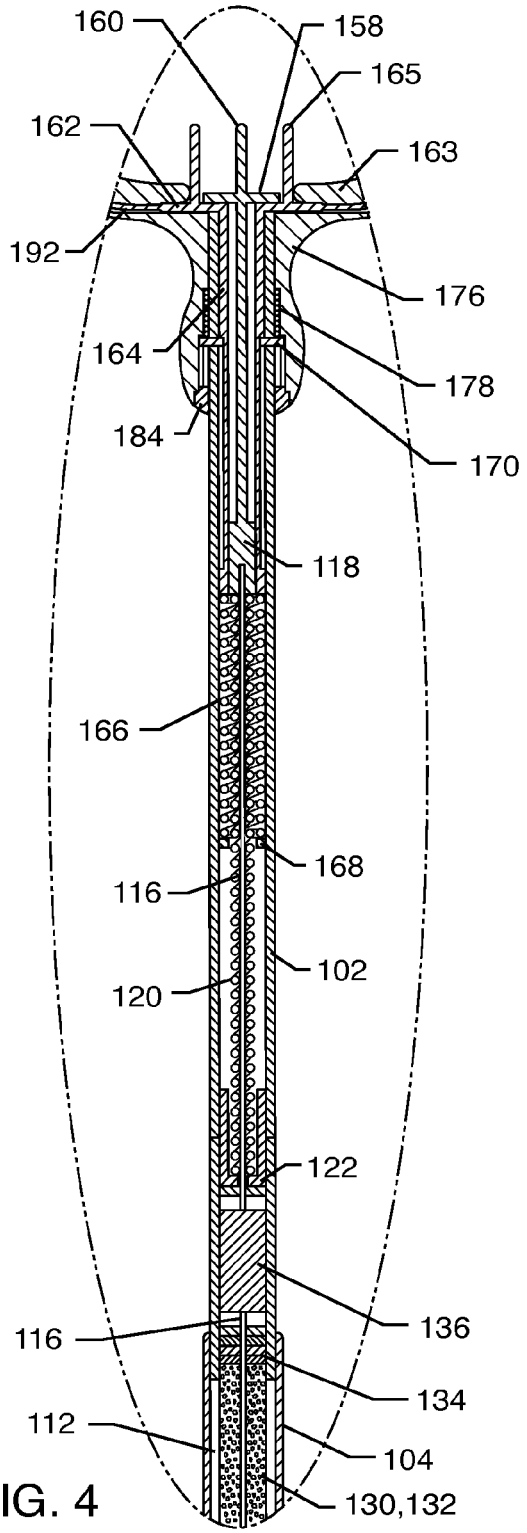
FIG. 4 is an enlarged cross-sectional view of area "4" of FIG. 2.
Figure 5:
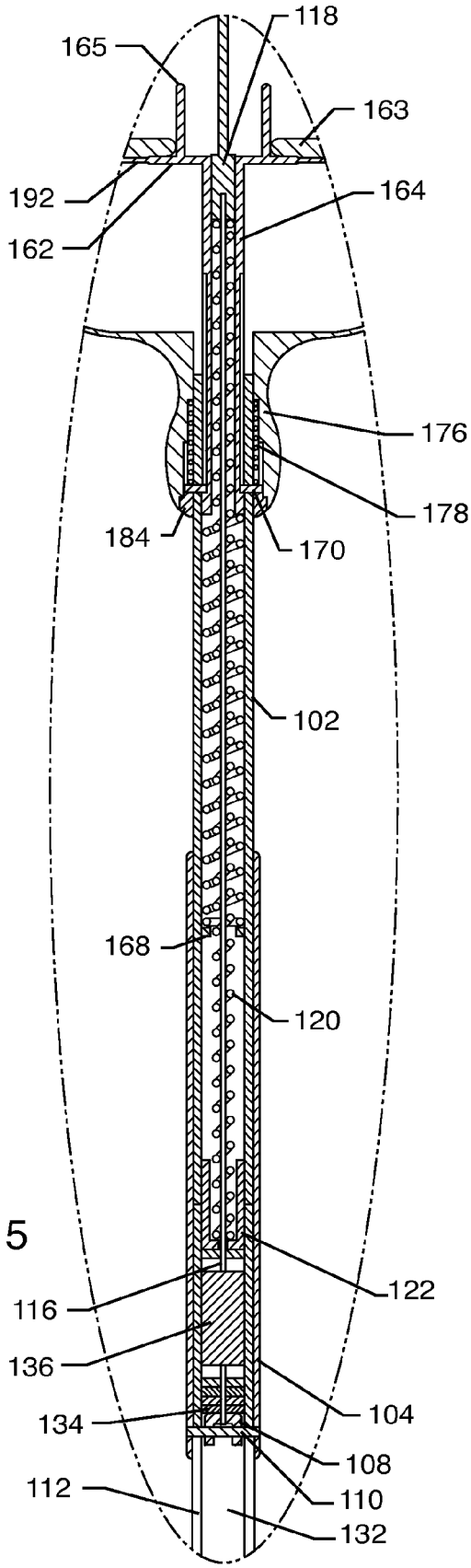
FIG. 5 is an enlarged cross-sectional view of area "5" of FIG. 3.

FIG. 2 illustrates the piston 108 in its lower most position with the chamber 132 filled with dissolvable solid material 130, and the flower 106 closed. FIG. 3 illustrates the piston 108 in its upper most position, stopped against washer 134, and the flower 106 in its fully opened state, such as after the solid material 130 has completely dissolved. The movement of the internal components within the stem 102 are best illustrated in FIGS. 4 and 5, wherein FIG. 4 illustrates the internal components while the flower 106 is closed, and FIG. 5 illustrates the internal components while the flower 106 is opened.

As the solid material 130 dissolves, the piston 108 is pulled upwardly by line 116, due to the tension of spring 120 pushing against the lower end of drive shaft 118. Drive shaft 118 has a gift-bearing platform 158 at an end thereof. This gift-bearing platform 158 rests in the bottom of the flower 106 when in the closed position, as illustrated in FIG. 4, but extends upwardly beyond the opened flower 106, as illustrated in FIG. 3. A gift (not shown) is hidden within the closed flower 106 and revealed by the opened flower 106. The gift-bearing platform 158 includes a gift securement means 160, which may comprise a pin or any other securement member for holding a gift on the platform 158. The gift securement means 160, such as in the form of the illustrated pin 160, may activate a gift electrical circuit, unstop or tear open a small liquid-filled packet to release a fragrance, or the like, when the gift is removed therefrom from the opened flower. Furthermore, one or more gift control pins 165 may be withdrawn from the gift to activate similar features as the gift is first lifted by the gift-bearing platform 158.

Figure 6:
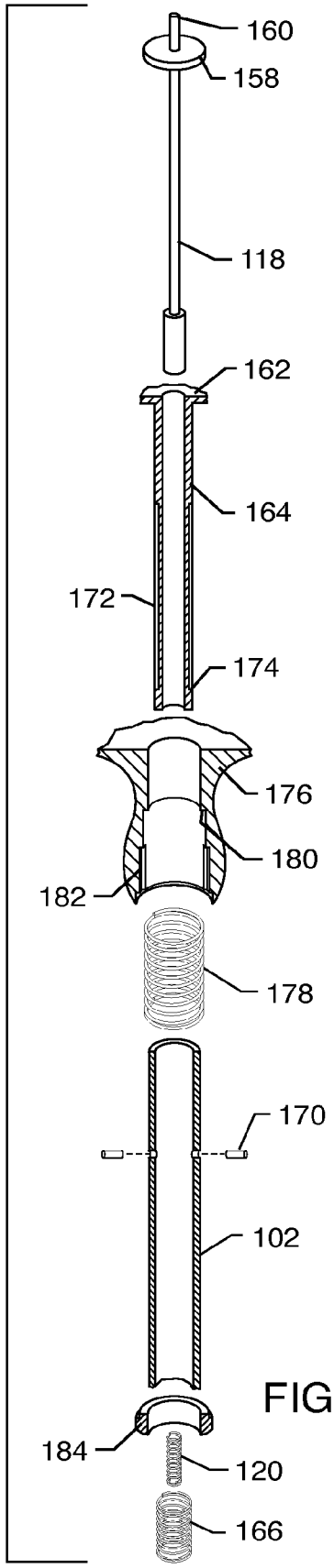
FIG. 6 is a partially fragmented, partially sectioned and exploded view of various components of the device of the present invention.
Figure 7:
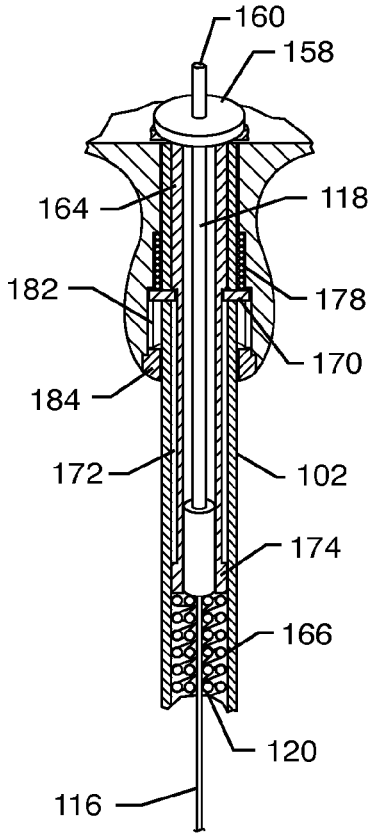
FIG. 7 is a partially fragmented and sectioned view of the components of FIG. 6 in an assembled and closed state.
Figure 8:
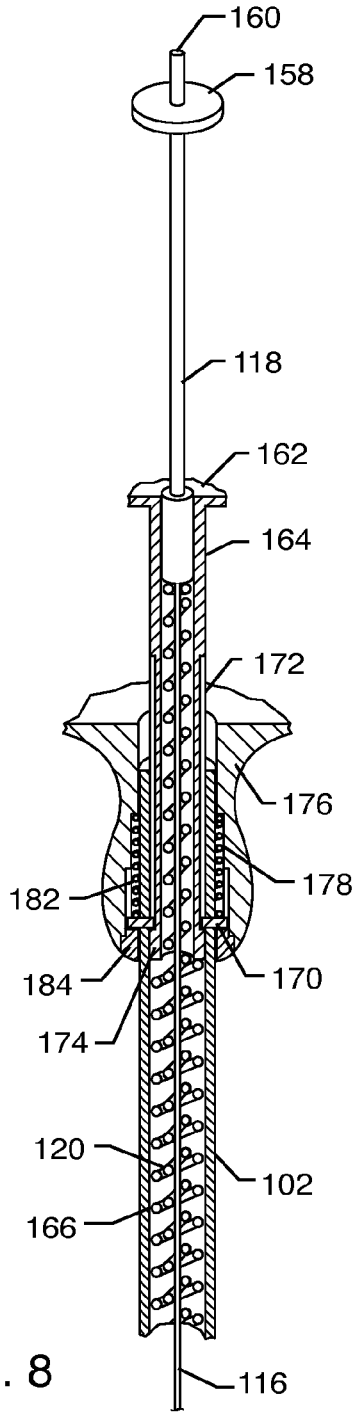
FIG. 8 is a partially sectioned and fragmented view similar to FIG. 7 in an assembled and opened state.

With reference now to FIGS. 6-8, the gift platform 158 engages an upper end of a petal base 162, having an inner stem 164 extending downwardly therefrom and into the stem 102. Spring 166, which is concentric with spring 120 and which extends between platform 168 and a lower end of the inner stem 164, biases the inner stem 164 upwardly. However, the stem 164 is held in place by the gift platform 158 when the piston 108 is in a locked position or prevented from moving upwardly by the presence of the solid material 130, as illustrated in FIG. 7. As the solid material 130 is dissolved, and the piston 108 rises, the upward movement of the gift platform 158 enables the inner stem 164 and petal base 162 to be pushed upwardly by spring 166, as illustrated in FIG. 8. Pins 170 reside in grooves 172 formed in the inner stem 164. The ledge 174 limits the range of motion of the inner stem 164 by contacting the pins 170. A petal cup base 176 is slidably disposed over the stem 102. A spring 178 is disposed within the petal cup base 176 and pushes against a ledge 180 of the petal cup base 176 and pins 170, so as to bias the petal cup base 176 upwardly. Grooves 182 formed in the petal cup base 176 allow the petal cup base 176 to slide upwardly along the stem 102, to give the illusion of flower growth, until the pins 170 come into contact with the stop plug 184 affixed at the lower end of petal cup base 176.

With reference again to FIGS. 1 and 2, the petal cup base 176 is connected to, or formed integrally with a petal cup 186. The petal cup 186 is relatively thick at the base thereof, and becomes progressively thinner towards the upper edge thereof. More particularly, a plurality of sepals 188 and 190 are formed alternately around the upper edge of the petal cup 186. Sepals 188 and 190 flex outwardly as they are overcome by the spring force of the petals hinges 192 while the petals hinges 192 are straightening as they are being lifted out of the petal cup 186 during flower opening action. The petal cup 186 and sepals 188 and 190 are preferably shaped to resemble a flower's calyx.

Petal hinges 192 are formed integrally with or attached to the petal base 162. The petal hinges 192 are normally flat and straight, and have a spring quality to allow them to be deflected into a curved or bow shape when lowered into the petal cup 186, but open generally flat and straight when lifted up beyond it. They may be tapered, such that the thickness is greater towards the petal base 176 and thinner towards the end thereof, to allow them to bend more readily into the shape of the petal cup when the flower 106 is closed.

Petal feet 194 are connected to the ends of the petal hinges 192. The petal feet are of a flat tapered shape, and support an inner petal 196 on the upper or inner side thereof, and an outer petal 198 on a lower or outer surface thereof. The petals are configured so as to resemble a natural flower's petals.

To more fully explain the movement of the component parts of the flower 106 of the device 100, once the solid material 130 has been exposed to solvent, and is dissolving, the piston 108 moves upwardly, as described above. The advancing piston 108 will, through line 116 and drive shaft 118, allow the gift platform 158 to lift by the force of spring 120. As the gift platform 158 lifts, it frees inner stem 164 and the petal base 162. This in turn allows the petal cup 186 to lift using the force of the petal cup spring 178. The petal cup 186 ends its travel when the affixed petal cup base plug 184 meets the lift stop pins 170. This process allows the gradual straightening of the petal hinges 192 to open the inner and outer petals 196 and 198. The sepals 188 and 190 initially resist the straightening of the petal hinges 192 as they are lifted up from within the petal cup 186 then bend outwardly in response to the greater force as the lifting continues.

The petal cup 186 and the inner stem 164 do not travel as far as the drive shaft 118 and the gift platform 158. Thus, after the petals 196 and 198 have been fully opened, the gift platform 158 continues lifting by the force of spring 120, and will only stop when all of the solid material 130 has been completely dissolved and the piston 108 meets the rubber stop washer 134.

It is contemplated by the present invention that the grooves 172 of the inner stem 164 and the grooves 182 of the petal cup base 176 may be formed in a non-linear manner, such as a helix, so that as the pins 170 travel along the grooves 172 and the grooves 182, the inner stem 164 and the petal cup 186 are forced into rotation as they lift. This, of course, will impart a rotation to the opening flower 106. The internal base of the flower 106 may include a decorative filler 163, such as a flexible decorative material in a round ring shape, to aesthetically cover the petal base 162 and other attached components from view after the flower 106 has been completely opened.

The Sepals 188 are thinner and more flexible than the adjacent sepals 190, and due to the fact they are arranged in an alternating manner around the upper perimeter of the petal cup 186, each petal hinge 192 is deflected into a curved shape during the closing of the flower 106 at a rate that varies slightly from its neighboring petal hinge 192. As the opened flower 106 is retracted back into the closed state, the thinner sepals 188 press inwardly against the adjacent lowering petals 198 with less pressure than do the thicker sepals 190, providing an orderly overlap and an avoidance of edge interference among the closing petals 198. In the closed flower 106, alternating outer petals 198 overlap neighboring outer petals in an orderly fashion. This permits the use of large overlapping outer petals 198 for additional realism and adds to the pleasing aesthetics when the flower is fully opened, as illustrated in FIG. 3.

Another artificial flower device 200 embodying the present invention is illustrated in FIGS. 18-21. Similar to the device 100 described above, this device 200 also includes a stem 202 having a piston 208 slidably disposed therein and connected to an outer sleeve 204 by means of pin 210. The sleeve 204 and the stem 202 include alignable apertures which provide access to an inner chamber 232, as described above, which can be filled with dissolvable solid material. The piston pin 210 can also be locked into place by twisting the sleeve 204 such that the pin 210 is locked into place, such as by entering a slot (not shown). However, instead of a flexible line or cord, this embodiment utilizes a piston rod 216 extending upwardly from the piston 208 and operably connected to the drive shaft 218, which is much more elongated in this embodiment 200.

There are additional differences, other than the use of a piston rod 216 in place of a line, between this device 200 and the device 100 previously described, although the general operation of the two are similar. In particular, the brake assembly 236 is of a different design to accommodate the lack of a flexible line. As illustrated in FIGS. 22-25, the brake assembly 236 is interconnected between the piston stem 216 and the drive shaft stem 218. A base 238, which is typically a round flat washer having an aperture therethrough to receive the piston shaft 216 is spaced apart from a top base 240 also having an aperture therethrough for receiving the drive shaft 218. The piston shaft 216 and the drive shaft 218 both have flared or otherwise enlarged ends so as to be retained in place by the plates 238 and 240, respectively. Posts 242 extend between and are affixed to the base plates 238 and 240 to hold them in spaced relation with respect to one another. Brake shoes 244, comprised of a normally flat metal leaf spring, have a brake pad 246 attached at each end thereof biased to rotate downwards and outwards. The center of the brake shoe leaf spring 244 is sandwiched between the flared head of the piston shaft 216 and the base plate 238, or may be otherwise connected to the base plate 238. A tension wire 248 extends from the free end of the brake shoe leaf spring 244, typically through the brake pad 246, as illustrated, and to a wire attach ring 250, sandwiched loosely between the upper base plate 240 and the flared head of the drive shaft 218.

Figure 24:
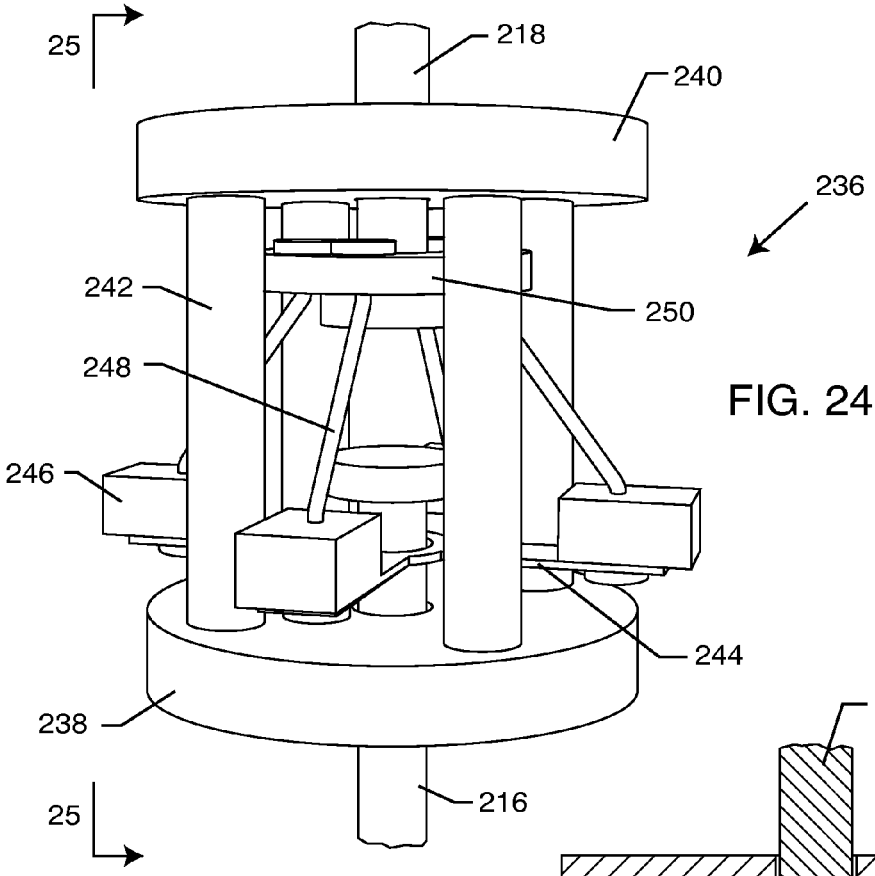
FIG. 24 is a perspective view of the braking assembly of FIG. 23, but in a braking position due to lost tension between a piston and drive shaft of the device.
Figure 25:
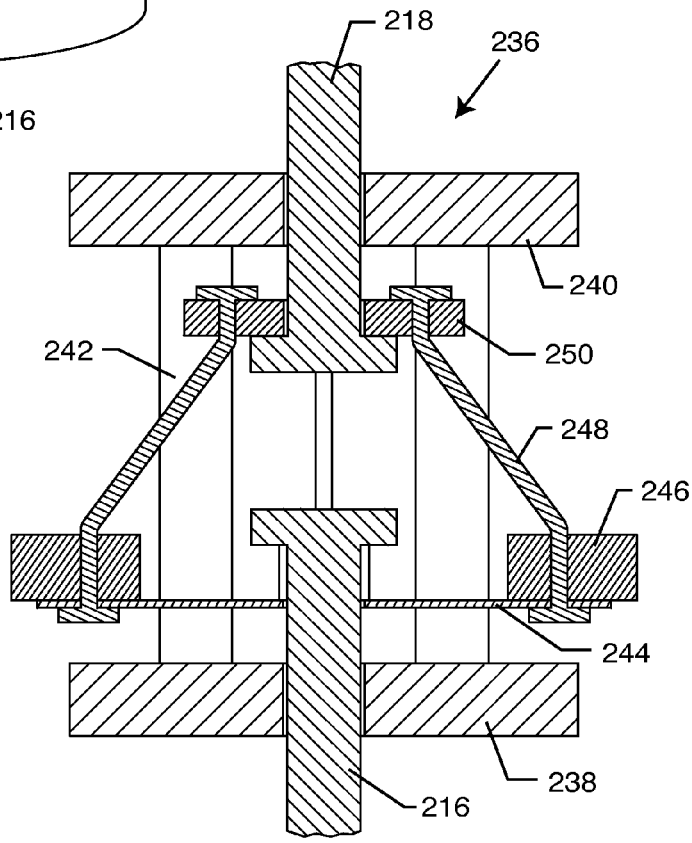
FIG. 25 is a cross-sectional view taken generally along line 25-25 of FIG. 24.

Normally, the piston rod 216 and drive shaft 218 are under tension, as will be explained more fully herein, and the brake shoe leaf spring 244 is pulled by the tension wire 248 at its outer ends and the piston rod 216 at its center into a bowed or cup shape. If the piston 208 is suddenly unstopped (manually retracted and released while the chamber 232 is less than full of dissolvable material), the tension will be lost and the flower operations will progress at a violently rapid rate. To prevent this, the brake assembly 236 acts to slow or stop the sudden advance of the moving assemblies in the event of lost tension. When tension is lost at piston rod 216, the brake shoe leaf spring 244 is allowed to return to its normally flat position, rotating brake pads 246 outwardly and downwardly. The brake pads 246 are biased to make contact with the internal surface of the stem 202, which surface may be treated to increase friction, to prevent the drive shaft 218 from advancing upwardly, being held by the tension wires 248. The base plates 238 and 240, joined by posts 242 create a surrounding box to limit the extent of deflection of brake shoe leaf spring 244 to prevent damage to the brake assembly 236 due to abuse. This is illustrated in FIGS. 24 and 25. Although as few as a single brake shoe 244 may be used, in a particularly preferred embodiment, two or more brake shoes 244 and pads 246 are used for uniform distribution of frictional contact between the brake pads 246 and the inner wall of the stem 202. Once the tension between the piston shaft 216 and the drive shaft 218 has been reestablished, the leaf spring brake shoes 244 will be pulled upwardly, and the brake pads 246 removed from contact with the inner surface of the stem 202.

Figure 18:
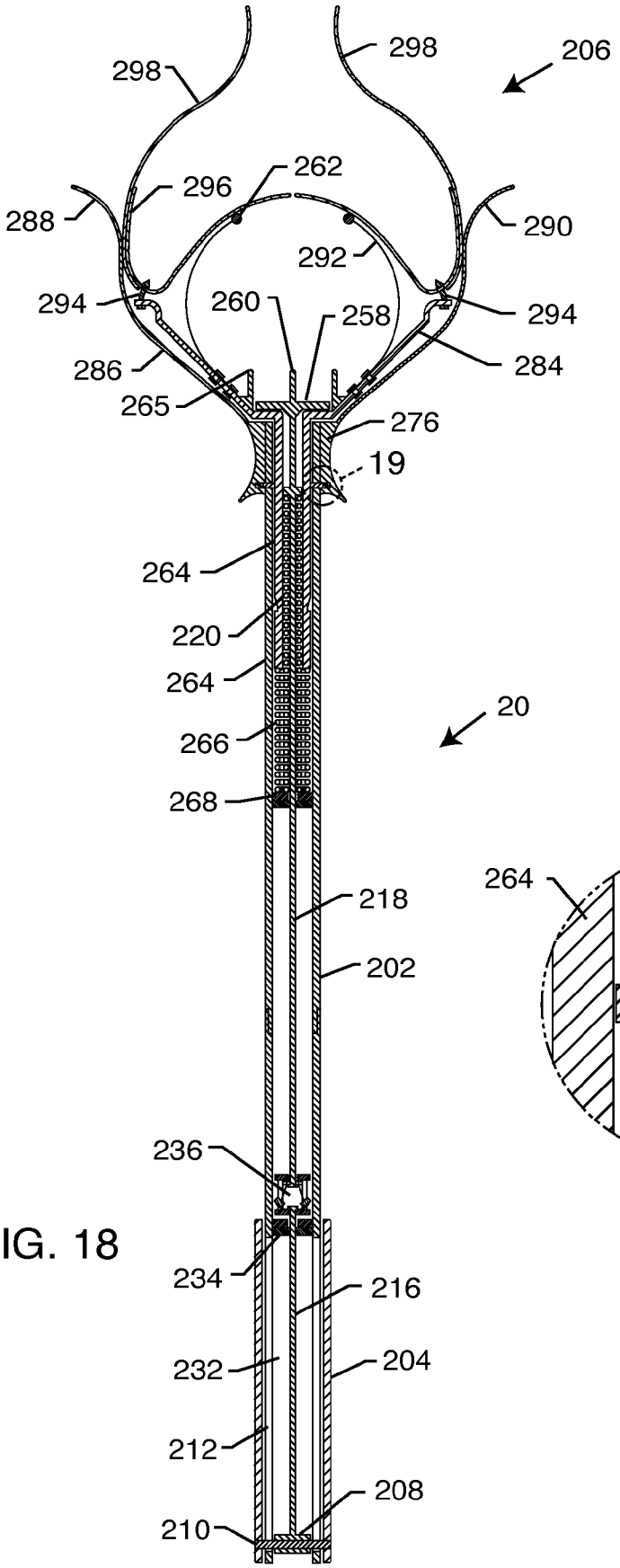
FIG. 18 is a cross-sectional view of another artificial flower device embodying the present invention in a closed state.
Figure 19:
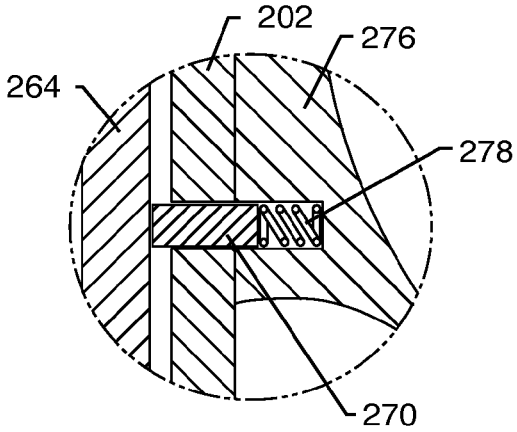
FIG. 19 is an enlarged sectional view of area "19" of FIG. 18, illustrating a stop pin used in accordance with the present invention.

With reference again to FIGS. 18-21, the device 200 is loaded with the dissolvable solid material (not shown), in a manner discussed above. The piston 208 thus resides below the solid material, and the flower 206 remains closed, as illustrated in FIG. 18. The retracted piston 208 stores energy in concentric coiled springs 220 and 266, which engage a platform 268 at one end thereof, and the drive shaft 218 and a lower end of the inner stem 264 at an opposite end thereof, respectively. When the device 200 is placed in solvent, such as a container of water, the solvent will infiltrate the cylinder stem 202 through the porous openings of the sleeve 204 and stem 202 and gradually dissolve the solid material in the chamber 232. Alternatively, the stem 202 or sleeve 204 could be composed of a porous material, such as a fine mesh screen, to facilitate entry of water into the chamber 232. The rate of dissolution may be varied, as discussed above.

The dissolving solid will allow the piston 208 to advance, and thus the drive shaft 218 to be moved upwardly by the force of spring 220. This moves the gift platform 258 upwardly, as discussed above and as illustrated in FIG. 20.

Movement of the gift platform 258 enables the inner stem 264 to move upwardly by the force of compressed spring 266. In this case, the petal base 276 is fixed to the stem 202. Pin 270 is biased towards the inner stem 264 by virtue of coil spring 278. The pin 270 and outer surface of the inner stem 264 slide past one another until engaging a ledge 282 formed in the inner stem 264, thus limiting further upward movement of the stem 264. The gift platform 258 continues lifting, however, by the force of only the drive shaft spring 220, and will stop when all of the dissolved material in chamber 232 is dissolved and the piston 208 meets its stop 234.

An outer petal cup 286 is bonded or formed integrally with the petal cup base 276. The petal cup 286 is configured and textured to resemble a flower's calyx.

Figure 20:
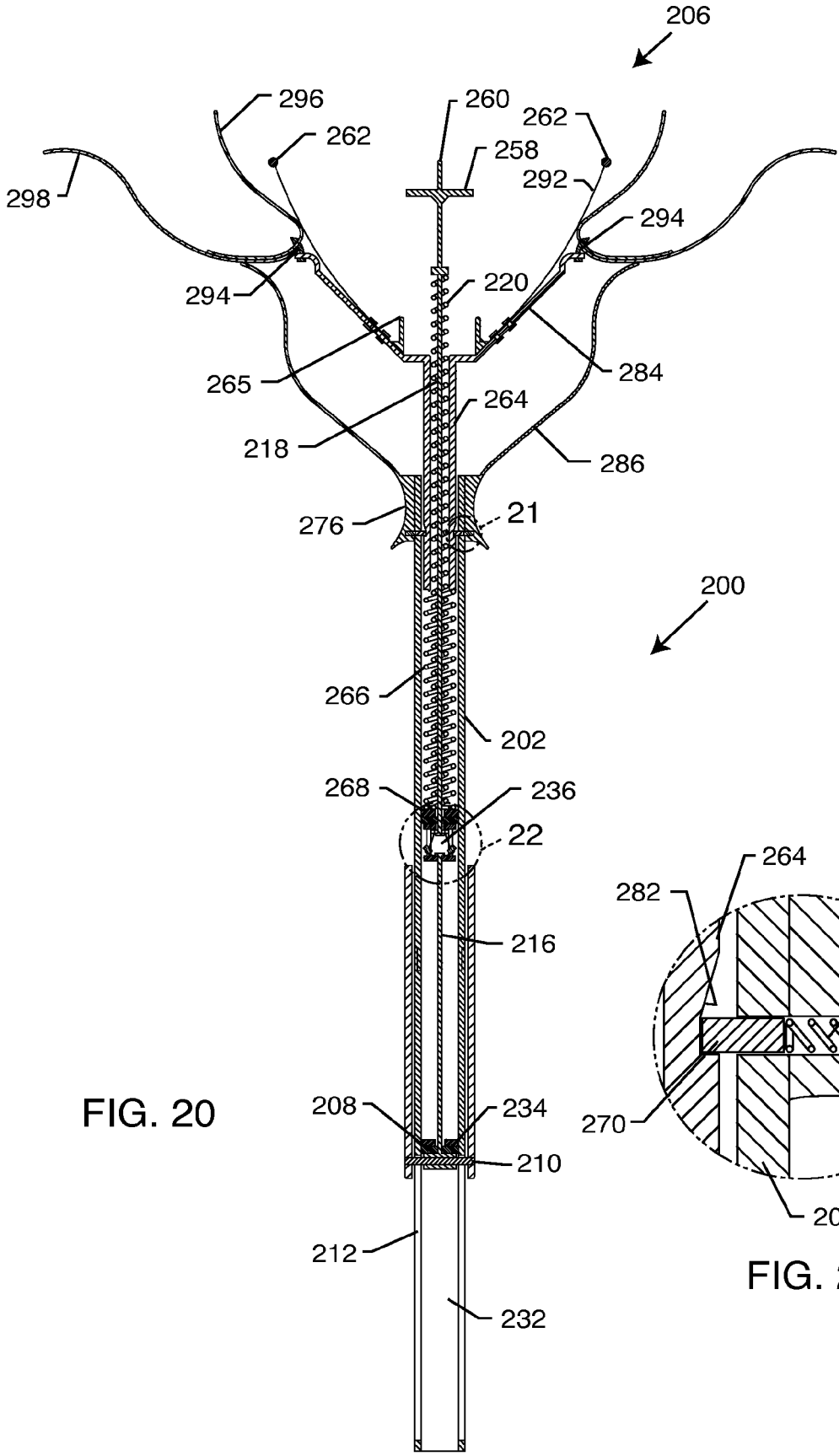
FIG. 20 is a cross-sectional view similar to FIG. 18, but illustrating the artificial flower device in an opened state.
Figure 21:
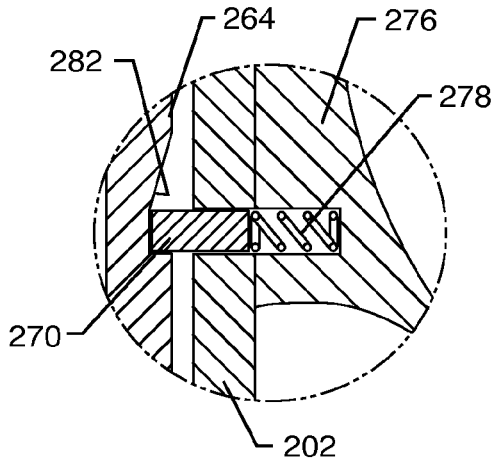
FIG. 21 is an enlarged sectional view of area "21", illustrating the stop pin extended into engagement with a groove of an inner stem of the device, in accordance with the present invention.
Figure 22:
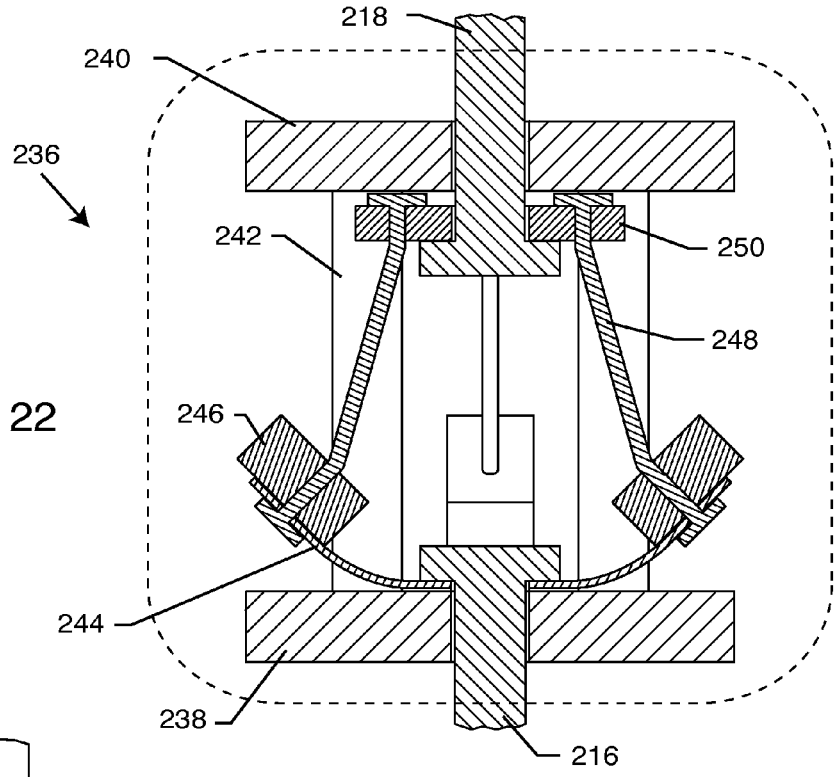
FIG. 22 is an enlarged sectional view of area "22" of FIG. 20, illustrating another brake system used in accordance with the present invention.
Figure 23:
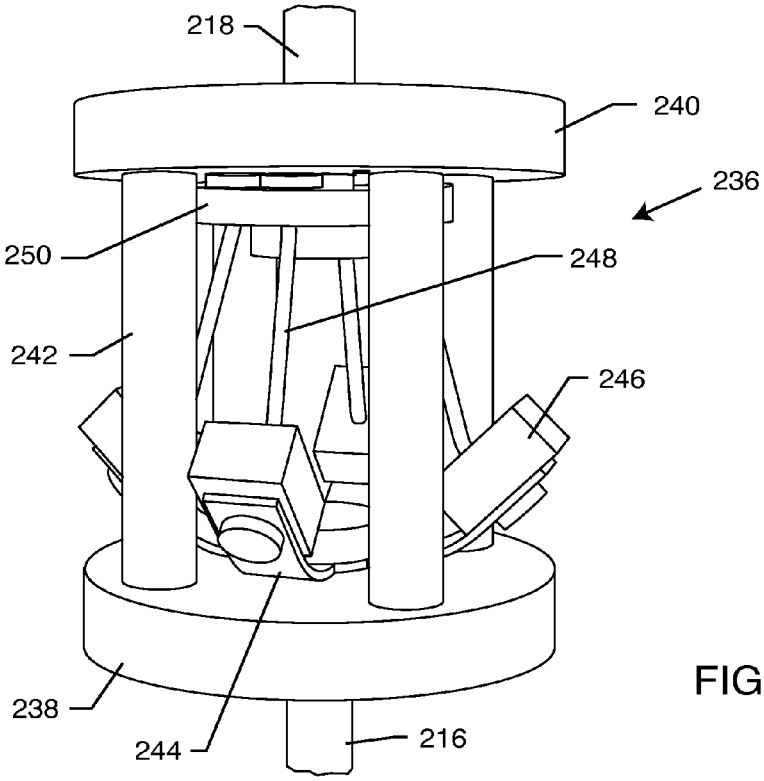
FIG. 23 is a perspective view of the brake assembly of FIG. 22, illustrating brake shoes thereof in a non-braking position.

With reference now to FIG. 20, as the inner stem 264 is raised, it also lifts an internal cup 284. Narrow leaf springs 292 are attached to the petal cup 284 and biased outwardly, so as to push the petals 296 and 298 outwardly. The petals 296 and 298 are connected to the petal cup 284 by means of flexible members 294, such as plastic rivets or the like. Preferably, a small nylon tip 262 on the spring 292 protects the affected surface from damage and provides a safe termination for the spring 292 that resembles a flower's anther. The spring 292, or other internal workings of the flower 206 may be further fully coated or have decorative filler and the like for aesthetic purposes.

After the flower has been opened, the gift can be viewed and removed from the platform 258. The device 200 can be reused by pulling sleeve 204 downwardly and locking the piston 208 in place, so as to expose the inner chamber 232 for filling with a solid dissolvable material, as described above. This will cause the flower 206 to be retracted into its closed position.

Figure 26:
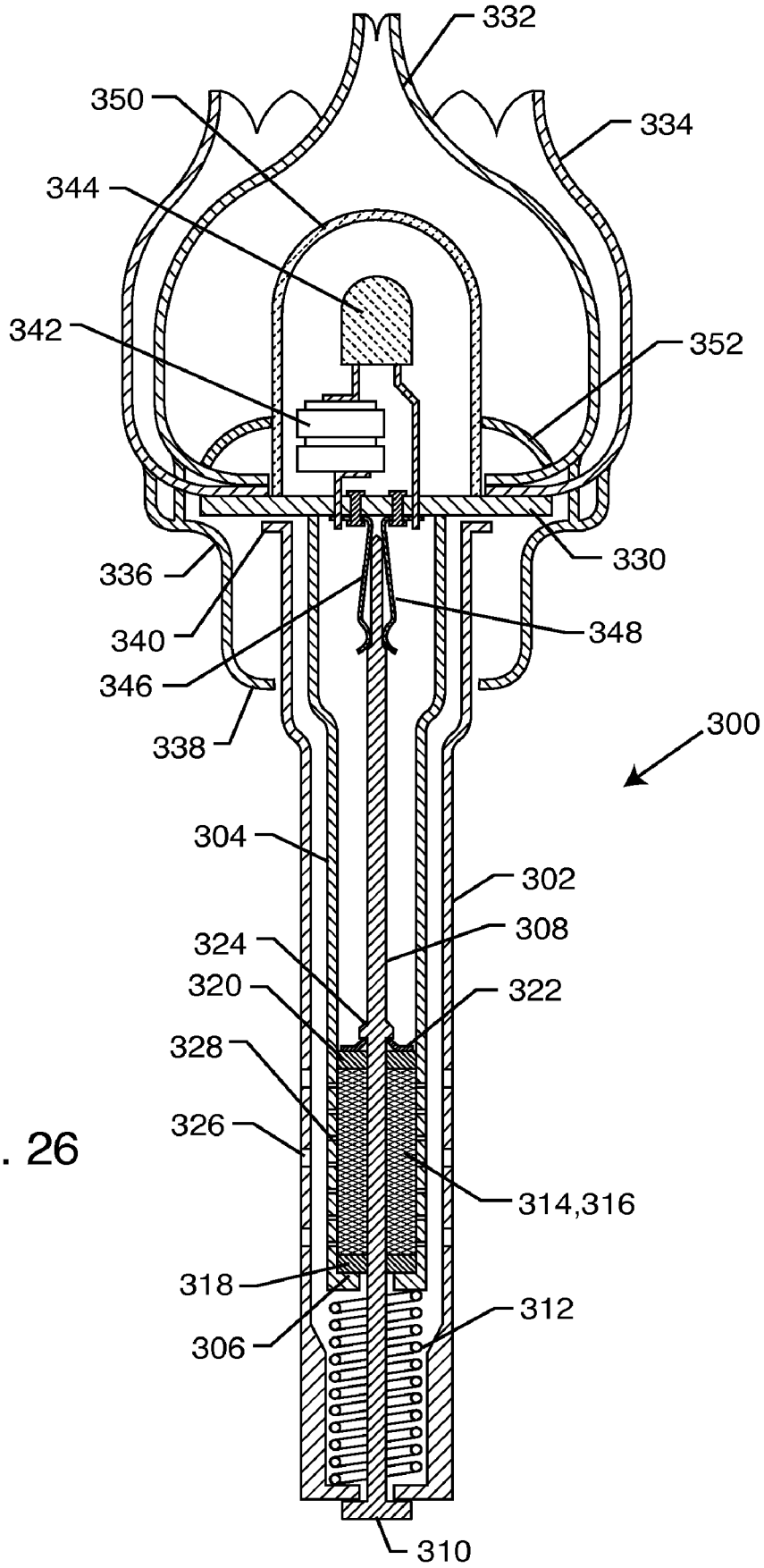
FIG. 26 is a cross-sectional view of yet another artificial flower device embodying the present invention, in its closed state.
Figure 27:
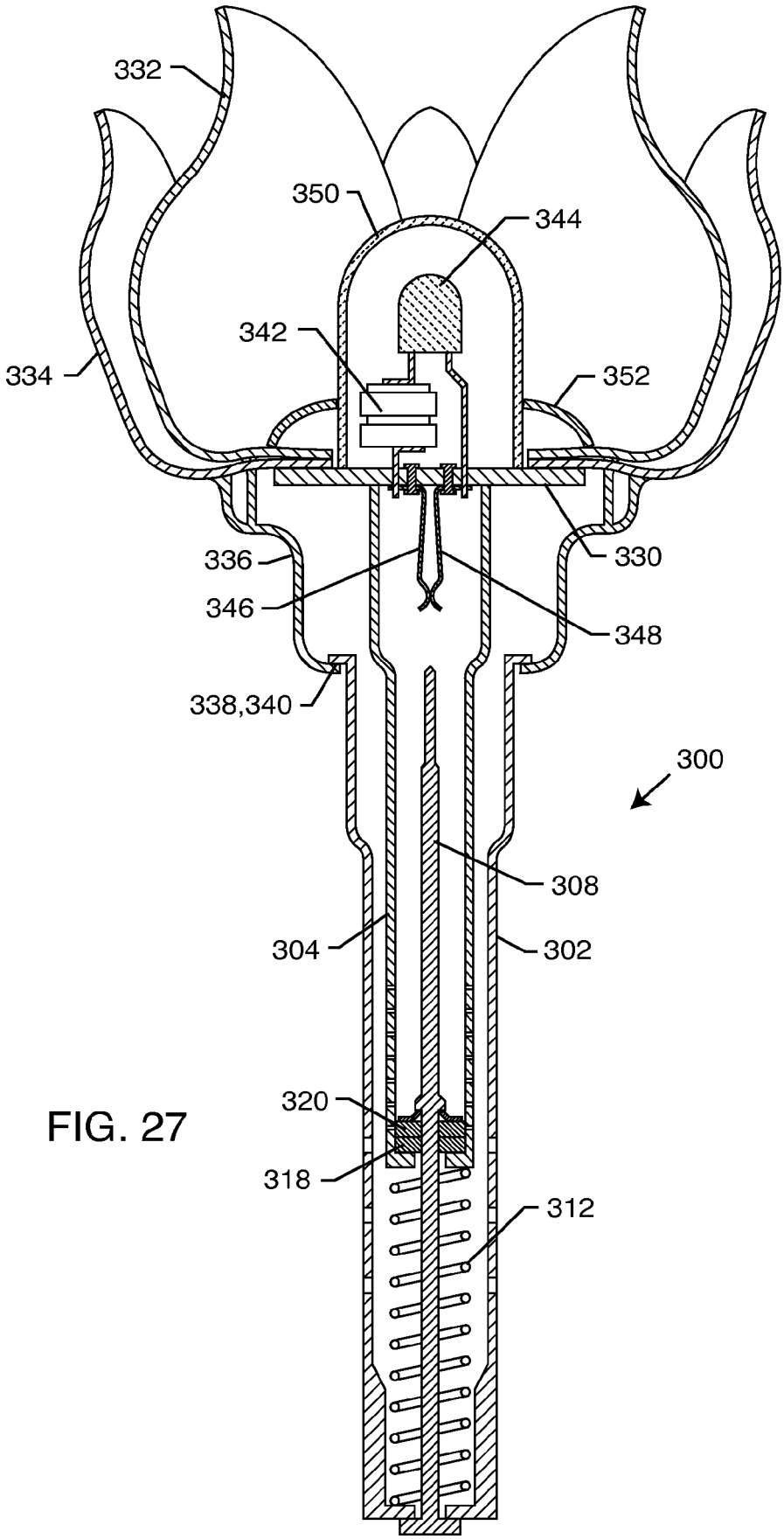
FIG. 27 is a cross-sectional view of the device of FIG. 26, illustrating the device in its opened state.

Referring now to FIGS. 26 and 27, yet another artificial flower device 300 embodying the present invention is illustrated. It should be noted that the devices herein are not necessarily drawn to scale, but rather the proportions have been somewhat exaggerated for visual clarity of the components thereof. Actual proportions and look of the finished devices are intended to be very similar to a real flower.

The device 300 includes an outer elongated tube comprising a stem 302. Within the stem 302 is a piston 304 which is closely spaced to the stem 302 and slidable therein. The piston 304 includes an aperture 306 in the base thereof which accepts a retaining rod 308 therethrough. The retaining rod or pin 308 has a flared end 310 which is attached to a lower portion or end of the stem 302. A spring 312 is disposed between the bottom of the piston 304 and the stem 302, and biases the piston 304 upwardly.

Similar to that described above, a chamber 314 is defined within the stem 302, and in this case more particularly the piston 304. Dissolvable solid material 316 is disposed within the chamber 314. Lower and upper washers 318 and 320 further define the chamber 314, hold the dissolvable solid material therebetween. A washer 322, having a spring retaining clip in the center portion thereof secures the position of washer 320. Washer 322 further is held by protrusion 324 of the retaining rod or pin 308.

Upon inserting the lower portion of the device 300 in a solvent, such as water, the water penetrates into the chamber 314 to dissolve the solid material 316. With the piston moved downwardly, and the spring 312 compressed, the flower portion of the device 300 remains closed. However, with the water entering into the chamber 314, and the solid material 316 dissolving, piston 304 is allowed to be moved upwardly by spring 312. The entrance of the water into the chamber 314 may be facilitated with apertures 326 and 328 formed in the stem 302 and piston 304, respectively.

As the piston 304 rises, it lifts all components that are attached directly or indirectly to it. That is, other than the stem 302, the spring 312, washers 320 and 322, and the retaining pin or rod 308, the remaining components of the device 300 are lifted.

The piston 304 is attached to a petal base 330, generally opposite the spring 312. Inner and outer petals 332 and 334 are attached at one end thereof to the petal base 330. A petal puller 336 is also attached to the inner and outer petals 332 and 334.

As the piston 304 rises, a flange 338 of the petal puller 336 contacts an upper ledge 340 of the stem 302 such that the petal puller 336 is stopped from rising. The petal puller 336 pulls the inner and outer petals 332 and 334 downward and into an open position, as illustrated in FIG. 27. However, the piston 304 upward movement is still not restricted and continues to rise.

The petal base 330 may include a gift platform, as discussed above. However, as illustrated, the petal base 330 may alternatively include an electronic circuit 342 including batteries, a light-generating device 344, such as a light-emitting diode, or even a sound-generating device. In the illustrated embodiment, the electronic circuit 342 includes a battery electrically connected to the light-emitting diode 344 at one end thereof, and having a contact 346 separated from another electrical contact 348 by the retaining pin 308. As the piston 304 is moved upwardly by spring 312, the retaining pin 308 eventually becomes dislodged from between the contacts 346 and 348. When this occurs, the contacts 346 and 348, which have spring characteristics, come into contact with one another to complete the circuit and illuminate the LED 344. Of course, this could be any other electronic device, such as a sound-generating device or the like. In a particularly preferred embodiment, the light-emitting diode 344 is covered by a pistil hood 350 which is bonded to the petal base 330. The pistil hood 350 is typically of a soft rubber material which is translucent or clear, and may have a velvet texture to simulate a pistil of a flower. Other decorative linings 352 and the like may be incorporated to make the internal appearance of the flower resemble a natural flower as much as possible.

The piston 304 continues to rise, illuminating LED 344 and pulling petals 332 and 334 open, until the lower washer 318 comes into contact with the upper washer 320, causing the piston 304 to stop its upper movement.

It will be appreciated by those skilled in the art that in the previous embodiments illustrated in FIGS. 1-25, that instead of a gift-bearing platform the flower device 100 or 200 may incorporate an electronic device, such as a light-generating device or a sound-generating device. It is even contemplated by the present invention that both a gift and/or gift platform be used in association with such an electronic circuit for creating illumination or sound when the gift is displayed in the open flower.

Figure 28:
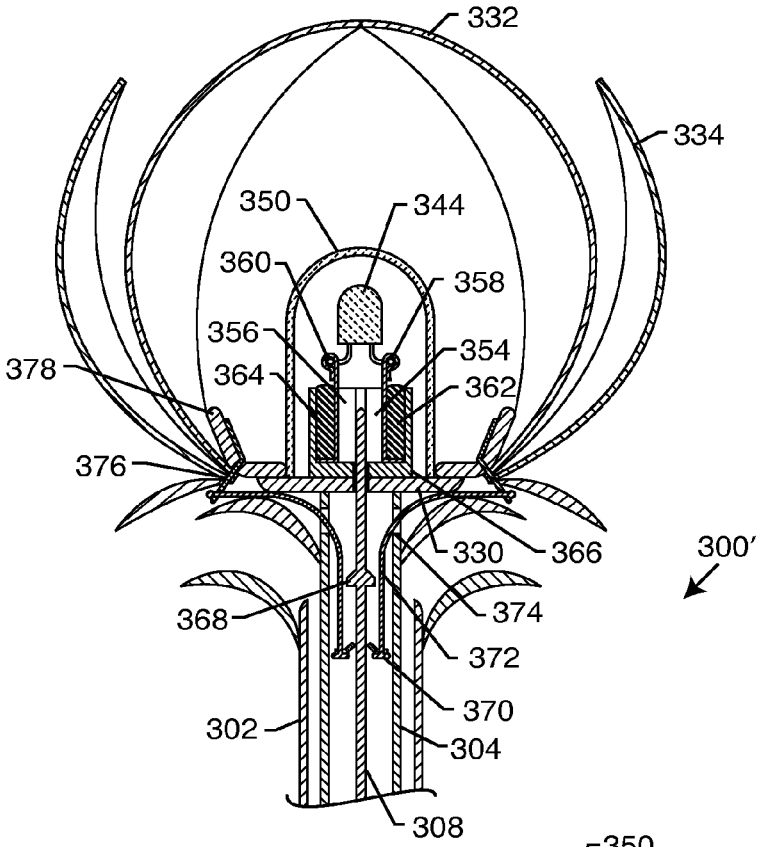
FIG. 28 is a partially fragmented and sectioned view of an upper portion of yet another flower device embodying the present invention, in a closed state.
Figure 29:
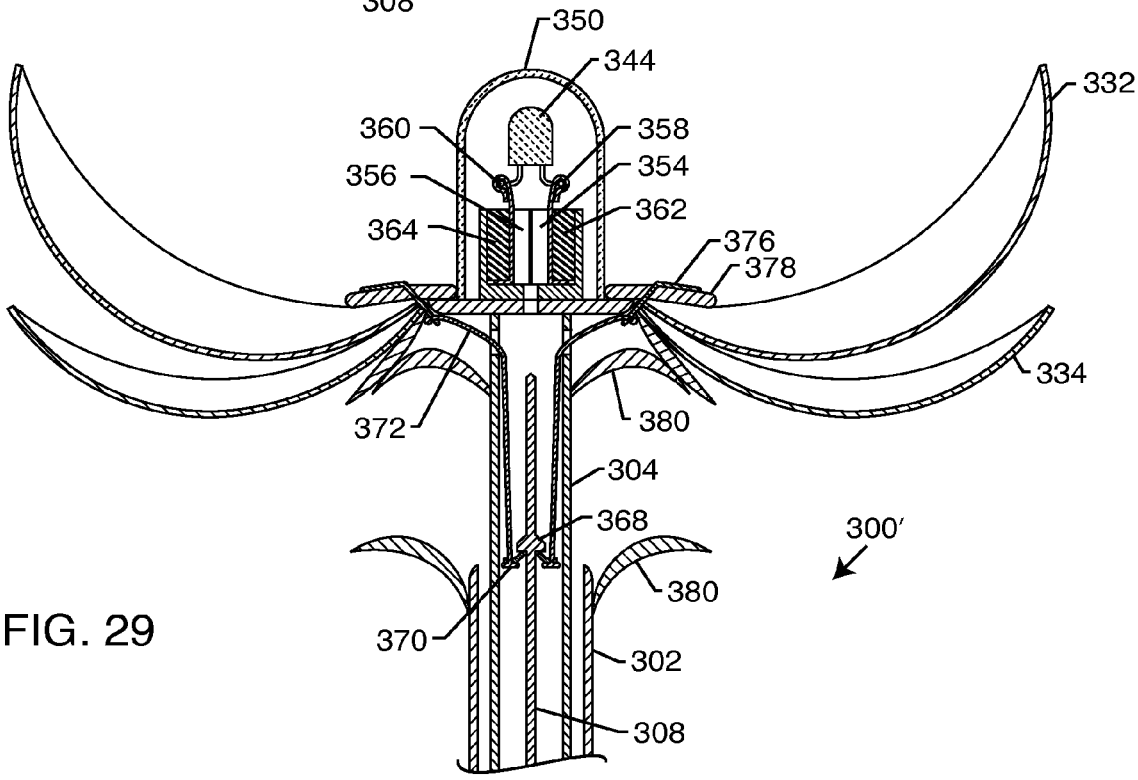
FIG. 29 is a cross-sectional view similar to FIG. 28, illustrating the artificial flower device in an opened state.

With reference now to FIGS. 28 and 29, a slightly different embodiment of the device 300' is illustrated. The stem 302, piston 304, and the lower portion of the device 300' are identical to that described above with respect to FIGS. 26 and 27. However, the arrangement of the electrical contacts and the petal puller design and arrangement have been altered. The piston 304 is attached to the petal base 330. The hood 350 overlies the light-emitting diode 344, or other electronic device, and is also attached to the petal base 330. However, the retaining pin 308 extends through the petal base 330 and between two batteries 354 and 356. One electrical contact of the batteries 354 and 356 is connected to an electrical contact or lead 358 and 360 for the LED 344. However, the other contacts of the batteries are separated by retaining pin 308. As the piston 304 and base 330 are moved upwardly, the retaining pin 308 is removed from between the batteries 354 and 356. Springs such as a foam rubber compressed material 362 and 364 is disposed within a housing 366 and once the retaining pin 308 is removed, expands forcing the batteries 354 and 356 to contact one another, thus closing the electrical circuit and illuminating the LED 344.

The process for opening the petals 332 and 334 is also different. The retaining pin 308 includes a stop 368 positioned above a retaining clip 370 having string or cords 372 attached thereto and extending through an aperture 374 of the piston 304 to a lever 376 extending through a lower portion of the petals 332 and 334 and into a mounting ring 378, typically comprised of a soft and flexible material, such as foam rubber. As the piston 304 is lifted, the stop 368 on the retaining pin 308 comes into contact with the retaining clip 370. This pulls the retaining clip 370 downwardly, tensioning the strings 372. Tensioning of the strings imparts tension upon the levers 376, causing the levers to pivot and pull the mounting ring 378 downwardly, opening the petals 332 and 334. The device 300' illustrated in FIGS. 28 and 29 includes leaves 380 which have been attached to the piston 304 and stem 302 to make the artificial flower device 300' appear more realistic, and it will be appreciated by those skilled in the art that such leaves 380 could be added to any of the embodiments illustrated herein.

Figure 30:
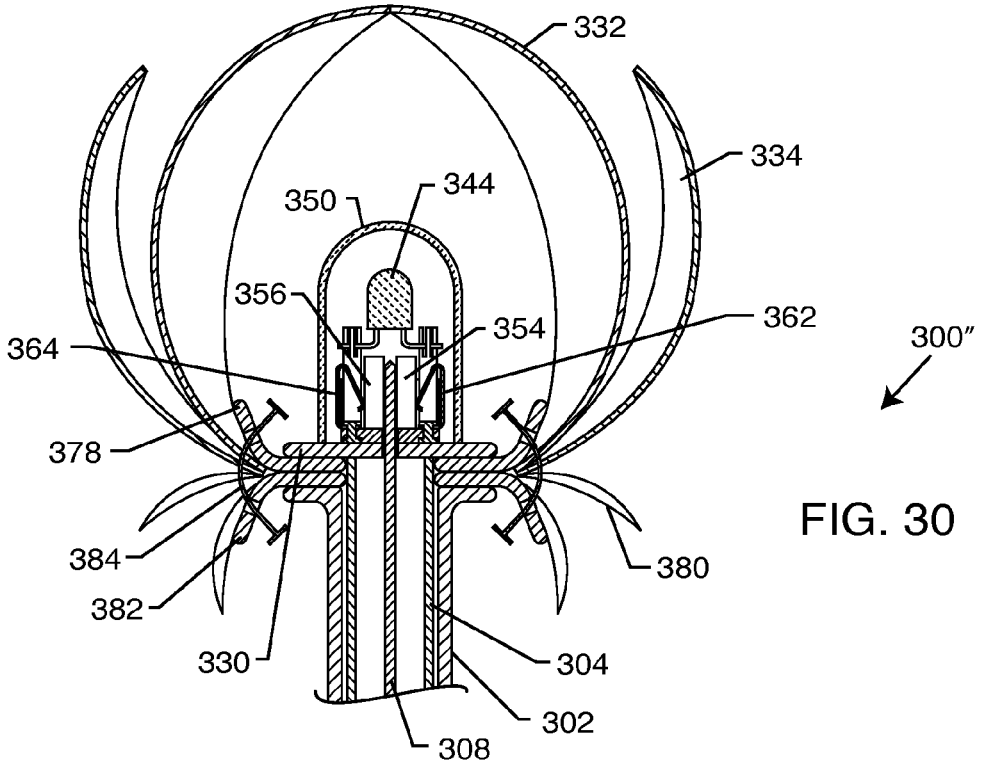
FIG. 30 is a partially fragmented and sectioned view of yet another artificial flower device embodying the present invention, illustrating its flower in a closed state.
Figure 31:
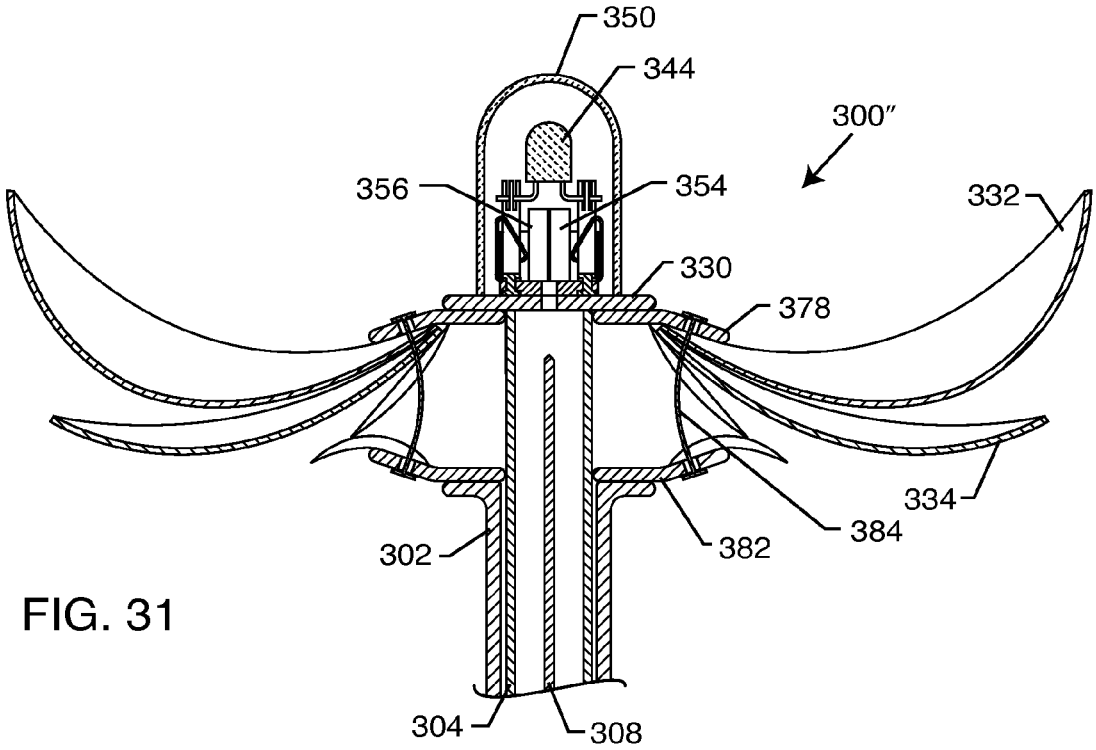
FIG. 31 is a cross-sectional view similar to FIG. 30, illustrating the artificial flower device in an opened state.

With reference now to FIGS. 30 and 31, yet another device 300" embodying the present invention is illustrated, which is very similar to that illustrated and described in FIGS. 26-29.

In this case, the retaining pin 308 is pulled from between batteries 354 and 356, and spring elements 362 and 364 force the batteries 354 and 356 into contact with one another to illuminate the LED 344, or other electronic device. However, in this case, a first mounting ring 378 is attached to the petal base 330, and has an end thereof which is resiliently flexible and curved upwardly. A second mounting ring 382 is attached to the top portion of the stem 302, and is also comprised of a resiliently flexible material with its outer edge or end bent downwardly in its natural state. A cord 384 or the like extends between the two outer edges of the mounting rings 378 and 382. As the piston rises, as illustrated in FIG. 31, the otherwise loose string 384 becomes tensioned, causing the ends or outer edges of mounting rings 378 and 382 to move towards one another, thus opening petals 332 and 334, as illustrated.

Figure 32:
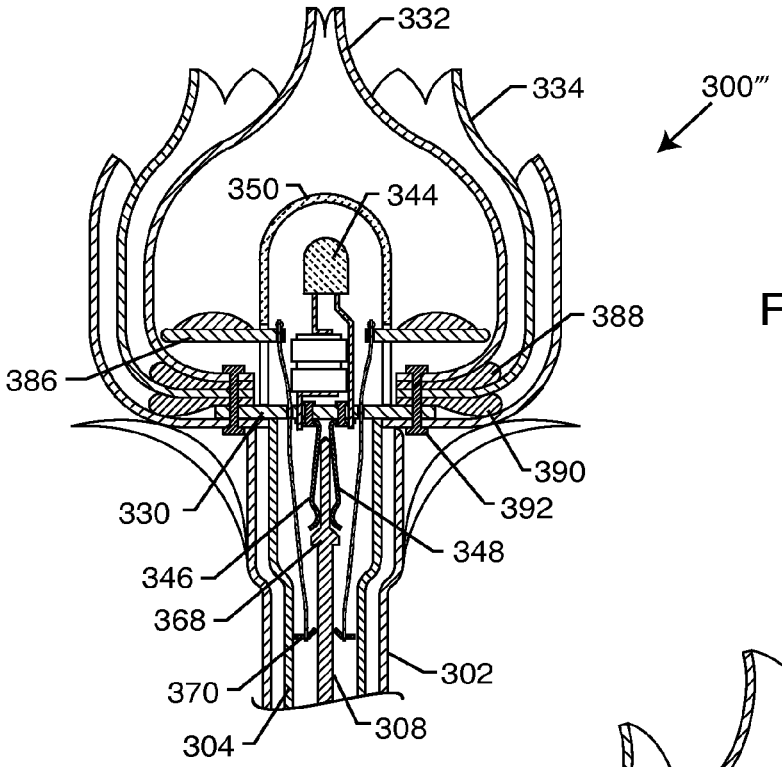
FIG. 32 is a cross-sectional view of yet another artificial flower device embodying the present invention in its closed state.
Figure 33:
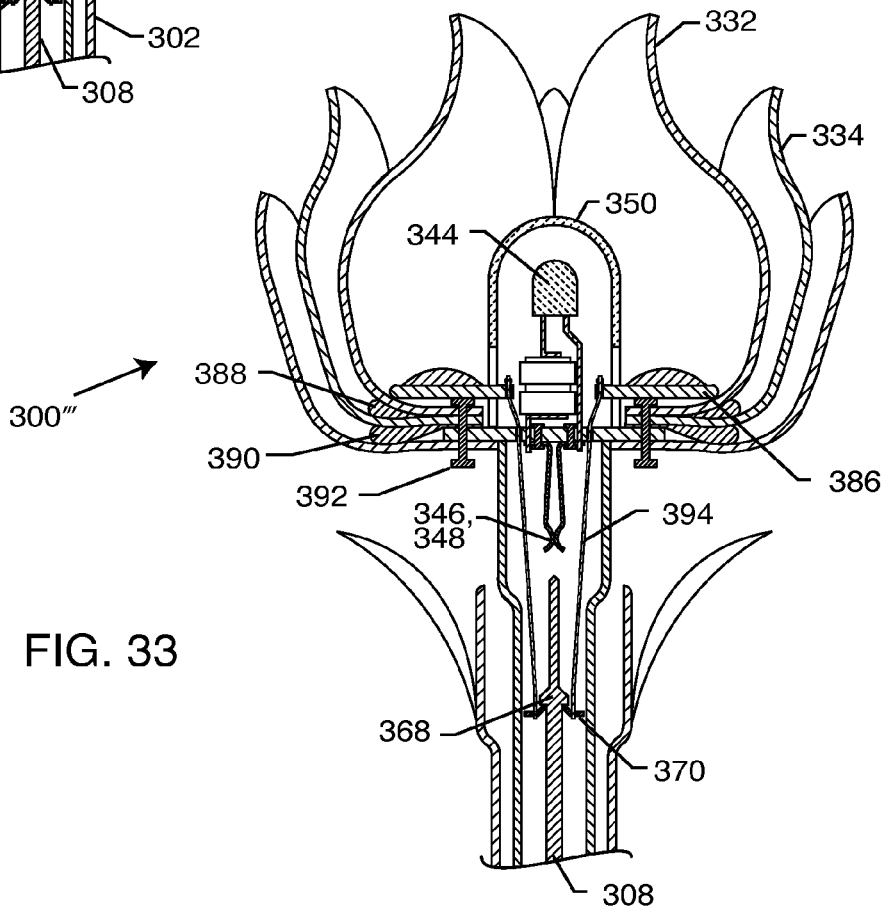
FIG. 33 is a cross-sectional view similar to FIG. 32, illustrating the artificial flower device in an opened state.

With reference now to FIGS. 32 and 33, yet another embodiment of the device 300''' is shown having slight variations to that discussed above. In this embodiment, a retaining pin 308 is disposed between electrical contacts 346 and 348, as discussed above with respect to FIGS. 26 and 27. However, the petal pulling mechanism is different. A petal opening ring 386 is attached through the LED hood cover 350. Typically, the opening of the petal ring 386 has spokes which pass through slots in the hood 350. Petal spacing rings 388 and 390 are disposed between the petals 332 and 334, and any additional layer of petals. Such petal spacing rings 388 and 390 are typically comprised of soft and elastic material. A rivet 392 or the like is used to hold the petals 332, 334, etc., the petal spacing rings 388, 390, etc. to one another as well as to the petal base 330. As the piston 304 is moved upwardly, stop 368 contacts clip 370, causing cord 394 to become taut and pull the petal opening ring 386 downwardly onto a lower portion of the petals 332 and 334, and the petal spacing rings 388 and 390. Such continued downward movement causes the petals 332 and 334 to open.

Figure 34:
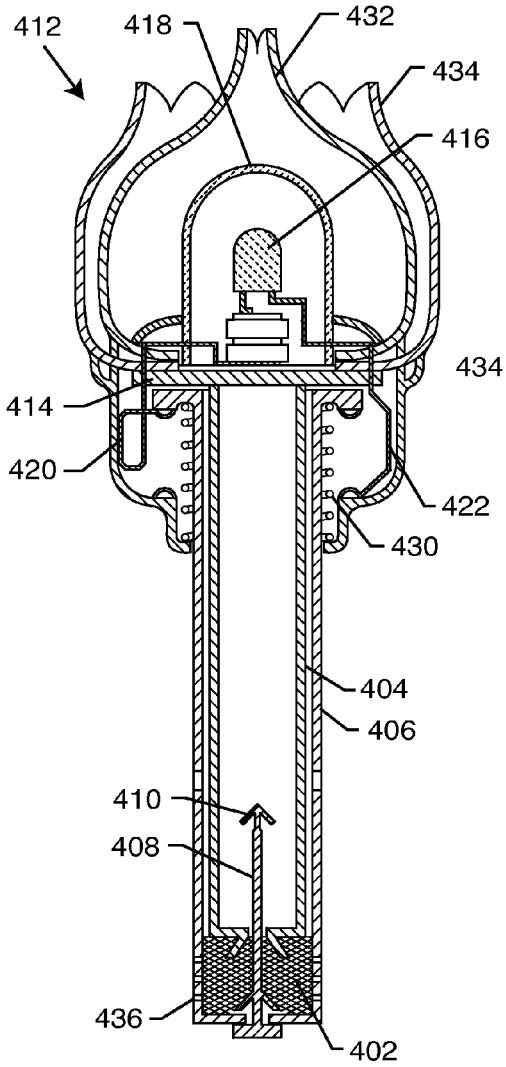
FIG. 34 is a partially fragmented and sectioned view of yet another artificial flower device embodying the present invention in a closed state.
Figure 35:
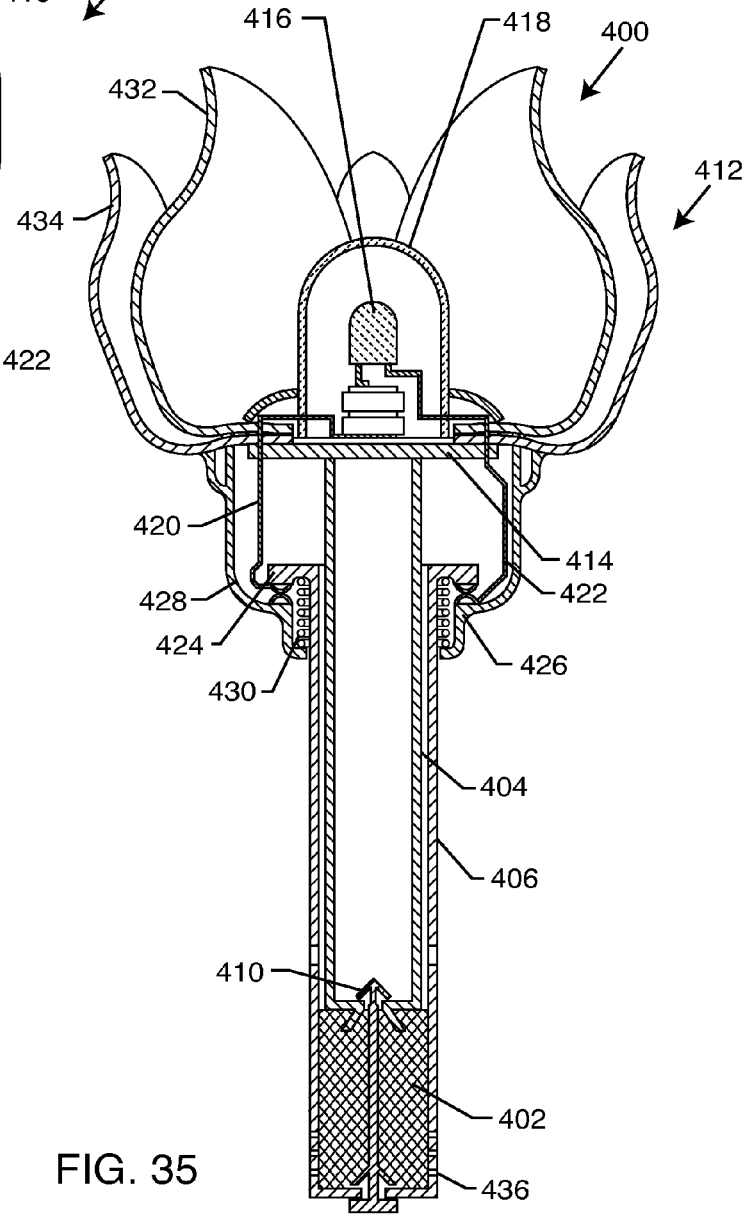
FIG. 35 is a cross-sectional view similar to FIG. 34, illustrating the flower in an opened state.

In all of the previous illustrated and described embodiments, the piston is biased either directly or indirectly by means of a spring. However, this need not be the case. With reference to FIGS. 34 and 35, a device 400 embodying the present invention is illustrated which utilizes an agent 402 which provides an expansive force as it absorbs water, such as a water-absorbing polymer or the like. This agent 402 is disposed below the piston 404 and within the stem 406. The piston 404 is slidably disposed within the stem 406. A guide pin 408 extends through the stem 406 and through the piston 404. The retaining guide pin 408 includes a stop 410, as will be described more fully herein. When the polymer material 402 is substantially dehydrated, the piston 404 is in its lower most position, and a flower portion 412 of the device 400 is closed. However, upon placing the stem 406 in water or other liquid, the polymer or other agent 402 absorbs the liquid and expands, as illustrated in FIG. 35, moving the piston 404 upwardly within the stem 406. Apertures 436 or the like are formed in the stem 406 to facilitate the intake of water into the chamber of the stem 406 containing the water-absorbing agent 402 so that the device 400 can be placed in a vase or other container of water and open the flower. This upward movement moves a petal base 414 upwardly and may include a gift-bearing platform or an electronic device 416, such as an LED or the like. The LED 416 may have a hood 418 or other such decorative cover. The electronic device 416 includes leads or electrical contacts 420 and 422, one of which is attached to an upper ledge 424 of the stem 406, and the other on an upper ledge 426 of a petal puller 428. These are normally biased away from one another with a spring 430, which is compressed as the piston 404 is moved upwardly. When the electrical contacts 420 and 422 come into contact with one another, the electronic circuit is closed and the electrical device, such as the LED 416, is activated. Simultaneously, the petal puller 428 is stopped by coming into contact with ledge 424, and pulls petals 432 and 434 downwardly so as to open the flower 412. The piston 404 movement is stopped when the piston 404 contacts retaining/guide pin stop 410.

Depending upon the water-absorbing agent 402, the device 400 may be reusable if the agent 402 sufficiently dehydrates and can be re-hydrated repeatedly.

Although several embodiments have been described in some detail for purposes of illustration, various modifications may be made without departing from the scope and spirit of the invention. Accordingly, the invention is not to be limited, except as by the appended claims.

What is claimed is:

1. An animated artificial flower device, comprising:

a simulated flower comprising at least one simulated petal, the simulated petal configured to be movable between a closed state and an opened state; and a chamber configured to receive a dissolvable material therein, the simulated petal configured to be held in the closed state by a presence of said dissolvable material in the chamber and moved towards the open state as the dissolvable material is removed by dissolution upon an exposure to a liquid, the rate of the movement of the simulated petal towards the open state corresponding to the rate of the dissolution by the liquid of the dissolvable material.

2. The device of claim 1, further comprising a gift platform configured to be concealed by the petal while the petal is in the closed state and extended upwardly relative to the simulated flower while the petal is in the opened state.

3. The device of claim 1, further comprising a simulated stem comprising at least one elongated tube, and at least one of a simulated calyx and a secondary simulated stem, slidable relative to the simulated stem, whereby a sliding motion of at least one of the simulated calyx and the secondary simulated stem, relative to the simulated stem, simulates flower growth.

4. An animated artificial flower device, comprising:

a simulated stem comprising at least one elongated tube;

a simulated flower comprising at least one simulated petal, the simulated petal configured to be movable between a closed state and an opened state;

at least one of a simulated calyx and a secondary simulated stem, slidable relative to the simulated stem, whereby a sliding motion of at least one of the simulated calyx and the secondary simulated stem, relative to the simulated stem, simulates flower growth; and a system of a pin and a groove interposing at least two of the simulated stem, the simulated calyx and the secondary simulated stem, wherein the groove comprises a non-linear path relative to a longitudinal axis of the simulated stem, whereby a rotational motion is imparted to the simulated flower as the flower growth is simulated.

5. The device of claim 4, further comprising a chamber configured to receive a dissolvable material therein, the simulated petal configured to be held in the closed state by a presence of said dissolvable material in the chamber and moved towards the open state as the dissolvable material is removed by dissolution upon an exposure to a liquid, the rate of the movement of the simulated petal towards the open state corresponding to the rate of the dissolution by the liquid of the dissolvable material.

6. A method for animating an artificial flower device, comprising:

placing a liquid and at least a portion of a simulated stem containing a dissolvable material into a container, thereby exposing the dissolvable material to the liquid; and opening replace at least one simulated petal of the artificial flower device at a rate corresponding to a rate of dissolution in the liquid of the dissolvable material.

7. The method of claim 6, further comprising revealing a surprise item as the simulated flower opens.

8. The method of claim 6, further comprising simulating flower growth at a rate corresponding to the rate of dissolution in the liquid of the dissolvable material.

* * * * *

UNITED STATES PATENT AND TRADEMARK OFFICE

CERTIFICATE OF CORRECTION

PATENT NO. : 7,842,359 B2
APPLICATION NO. : 11/561208
DATED : November 30, 2010
INVENTOR(S) : Peter Marlow It is certified that error appears in the above-identified patent and that said Letters Patent is hereby corrected as shown below:

At column 15, line 5, in Claim 6, please delete "opening replace" and insert --opening--, therefor.

Signed and Sealed this
Twenty-sixth Day of July, 2011

David J. Kappos

David J. Kappos
*Director of the United States Patent and Trademark Office*